US011821670B1

(12) United States Patent
Lamb et al.

(10) Patent No.: US 11,821,670 B1
(45) Date of Patent: Nov. 21, 2023

(54) ICE SHAVING SYSTEM HAVING EXTERNALLY ACTUATABLE MOTOR SWITCH

(71) Applicant: KONA ICE, INC., Florence, KY (US)

(72) Inventors: Anthony B. Lamb, Walton, KY (US); Scott D. Mackey, Piedmont, SC (US)

(73) Assignee: Kona Ice, Inc., Florence, KY (US)

( * ) Notice: Subject to any disclaimer, the term of this patent is extended or adjusted under 35 U.S.C. 154(b) by 404 days.

(21) Appl. No.: 17/076,233

(22) Filed: Oct. 21, 2020

(51) Int. Cl.
*F25C 5/12* (2006.01)

(52) U.S. Cl.
CPC ..... *F25C 5/12* (2013.01)

(58) Field of Classification Search
CPC .... F25C 5/02; F25C 5/046; F25C 5/12; Y10S 241/17; B67D 1/124; B67D 3/0025
USPC ..... 241/DIG. 17
See application file for complete search history.

(56) References Cited

U.S. PATENT DOCUMENTS 2,665,852 A * 1/1954 Shively ..... F25C 5/02 241/257.1
4,113,190 A * 9/1978 Fudman ..... B02C 18/12 D7/374
4,718,610 A * 1/1988 Gallaher ..... F25C 5/12 241/285.2
D295,898 S 5/1988 Rupp
5,033,256 A 7/1991 Rupp
5,050,809 A 9/1991 Rupp
5,112,135 A 5/1992 Rupp
5,129,549 A * 7/1992 Austin ..... B67D 1/0082 222/129.1
5,242,125 A 9/1993 Rupp
D434,157 S 11/2000 Rupp
6,527,212 B2 3/2003 Rupp
6,908,053 B2 6/2005 Rupp
D604,671 S 11/2009 Rupp
8,157,136 B2 4/2012 Lamb et al.
D690,148 S 9/2013 Rupp
D690,149 S 9/2013 Rupp
D690,155 S 9/2013 Rupp
8,939,389 B2 1/2015 Rupp
D731,860 S 6/2015 Rupp
D747,631 S 1/2016 Rupp
9,409,135 B2 8/2016 Rupp
9,441,871 B2 9/2016 Rupp
9,549,564 B2 1/2017 Rupp
9,668,498 B2 6/2017 Rupp
D807,703 S 1/2018 Rupp
(Continued)

*Primary Examiner* — Katrina M Stransky
*Assistant Examiner* — Jared O Brown
(74) *Attorney, Agent, or Firm* — Frost Brown Todd LLP

(57) ABSTRACT

An ice shaving system includes a body and a driven member positioned within the body. The driven member is drivable to produce shaved ice. The ice shaving system also includes a motor configured to selectively drive the driven member and a spout having an outlet. The spout is configured to dispense the shaved ice via the outlet. The ice shaving system further includes a shaping device configured to form a portion of the dispensed shaved ice with a predetermined shape. At least a portion of at least one of the spout or the shaping device defines a movable structure that is movable relative to the body. The motor is selectively activatable to drive the driven member in response to actuation of the movable structure relative to the body.

6 Claims, 14 Drawing Sheets

(56) References Cited

U.S. PATENT DOCUMENTS

| | | | | |
|---|---|---|---|---|
| D812,961 | S | 3/2018 | Rupp | |
| 10,130,111 | B2 | 11/2018 | Rupp et al. | |
| D834,871 | S | 12/2018 | Rupp | |
| D834,877 | S | 12/2018 | Rupp | |
| D834,880 | S | 12/2018 | Rupp | |
| 10,215,468 | B2 | 2/2019 | Rupp | |
| 10,252,229 | B2 | 4/2019 | Rupp | |
| D850,840 | S | 6/2019 | Rupp | |
| D850,841 | S | 6/2019 | Rupp | |
| 10,378,807 | B2 | 8/2019 | Rupp | |
| 10,433,569 | B2 | 10/2019 | Rupp | |
| 10,443,916 | B2 | 10/2019 | Rupp | |
| D866,244 | S | 11/2019 | Rupp | |
| D866,245 | S | 11/2019 | Rupp | |
| 10,555,546 | B2 | 2/2020 | Rupp | |
| 10,618,020 | B2 | 4/2020 | Rupp | |
| D884,426 | S | 5/2020 | Rupp | |
| 10,676,008 | B2 | 6/2020 | Rupp | |
| 10,794,624 | B2 | 10/2020 | Rupp | |
| 10,801,769 | B2 | 10/2020 | Rupp | |
| 2004/0016772 | A1 | 1/2004 | Rupp | |
| 2004/0021020 | A1 | 2/2004 | Rupp | |
| 2007/0163285 | A1* | 7/2007 | An | F25C 5/22 62/344 |
| 2008/0031087 | A1* | 2/2008 | Pryor | A47J 43/0716 366/194 |
| 2017/0135373 | A1 | 5/2017 | Rupp | |
| 2019/0045808 | A1 | 2/2019 | Rupp et al. | |
| 2019/0264971 | A1 | 8/2019 | Rupp | |
| 2019/0323754 | A1* | 10/2019 | Rupp | A23G 9/28 |
| 2019/0390888 | A1 | 12/2019 | Rupp | |
| 2020/0003472 | A1* | 1/2020 | Rupp | A23G 9/225 |
| 2020/0109887 | A1 | 4/2020 | Rupp | |

* cited by examiner

ICE SHAVING SYSTEM HAVING EXTERNALLY ACTUATABLE MOTOR SWITCH

BACKGROUND

Shaved ice is a frozen confection produced from either large blocks of ice or small pieces (e.g., cubes) of ice via an ice shaving machine (or "ice shaver"). For example, a block ice shaver having a rotating blade may be used to produce shaved ice from a single large block of ice, or a cubed ice shaver having a stationary annular blade and a rotating paddle wheel (or "scraper") wheel may be used to produce shaved ice from a plurality of small pieces or cubes of ice. In either case, the resulting shaved ice may be dispensed and subsequently flavored using one or more liquid toppings, such as syrup, to thereby produce a finished shaved ice product.

Conventional ice shaving machines include a stationary housing (e.g., a cabinet) which contains various internal components configured to produce shaved ice, such as a driven member (e.g., a rotating blade or ice scraper wheel) and a motor configured to selectively drive the driven member. Such ice shaving machines may further include a stationary spout having an outlet positioned external to the housing for dispensing the shaved ice into a cup, and a stationary shaping device (or "former") configured to form a dome-shaped top on the dispensed shaved ice. Typically, the motor may be selectively activated by the user via an electromechanical switch in operative communication with the motor. Such a switch is usually positioned directly on the housing remotely from the spout and the former for manual actuation by the user. Thus, the user is required to position an empty cup below the spout and separately actuate the switch (e.g., with a separate hand from that holding the empty cup).

While certain ice shaving machines are known, it is believed that no one prior to the inventors has made or used the invention described in the appended claims.

BRIEF DESCRIPTION OF THE DRAWINGS

The drawings and detailed description that follow are intended to be merely illustrative and are not intended to limit the scope of the invention as contemplated by the inventors.

DETAILED DESCRIPTION

Figure 1:
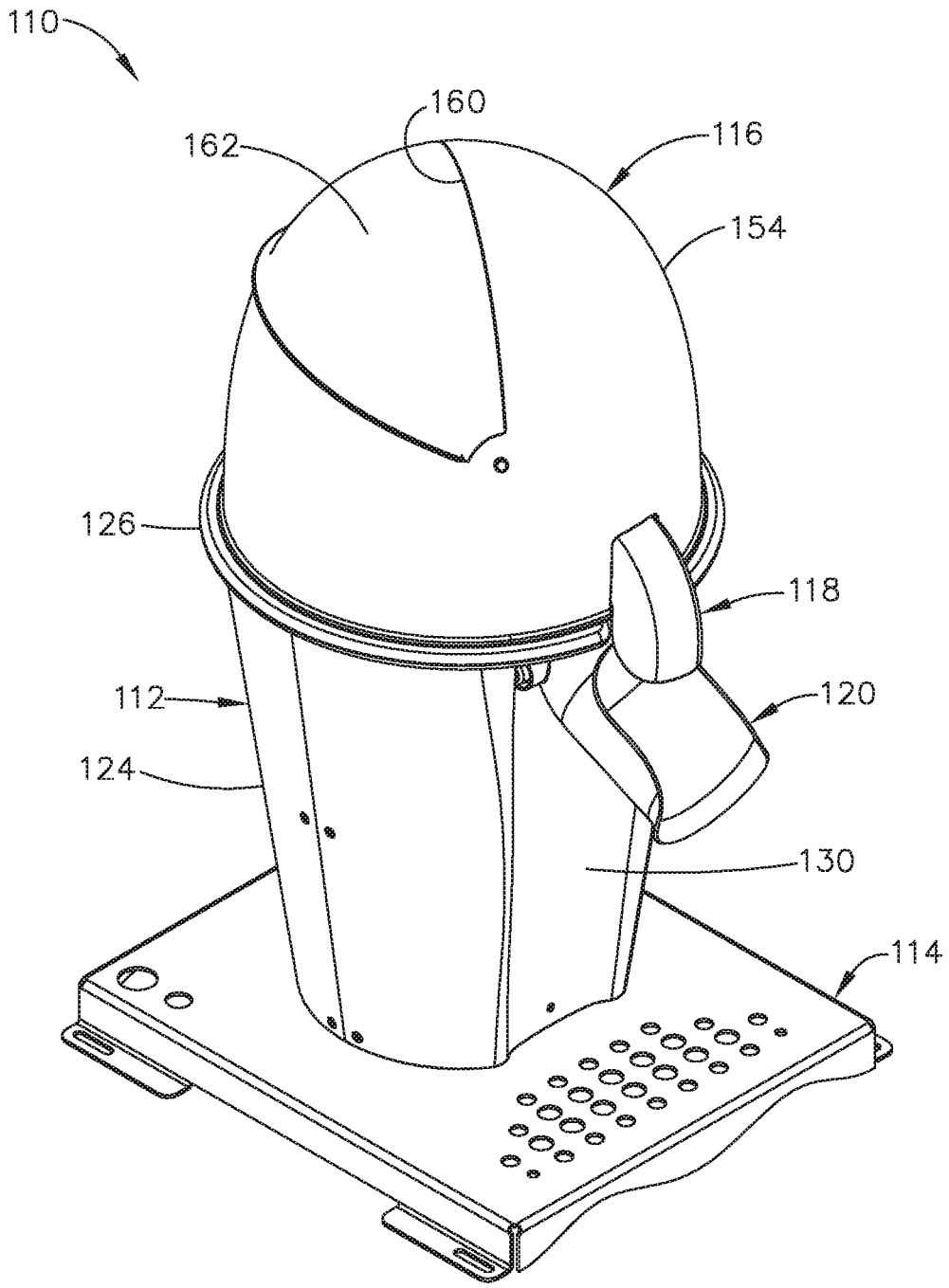
FIG. 1 depicts a perspective view of an exemplary ice shaving machine.

The following description of certain examples of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

I. Exemplary Ice Shaving Systems

In some instances, it may be desirable to provide an ice shaving machine (also referred to herein as an "ice shaving system") having a spout and a former, where at least a portion of the spout and/or the former defines a movable structure being movable relative to a housing of the ice shaving machine, and further having a motor configured to drive a driven member (e.g., a rotating blade or scraper wheel) in response to user-actuation of the movable structure relative to the housing by a user. Providing activation of the motor responsive to the actuation of such a movable structure may enable improved user interaction with the ice shaving machine, such as by simplifying and/or reducing the user input required to produce shaved ice for a shaved ice product. Each of the exemplary ice shaving machines (110, 210, 310, 410, 510, 610, 710, 810, 910, 1010*a*, 1010*b*, 1110) described below functions in such a manner.

A. Exemplary Ice Shaving Machine Having Pivotable Former

FIGS. 1-6D show an exemplary ice shaving machine (or "ice shaver") (110) comprising a stationary housing (112) mounted on top of a perforated drain plate (114), and a hopper (116) selectively attached to housing (112) for receiving ice. It will be understood that housing (112) and hopper (116) collectively define a body of ice shaving machine (110). Ice shaving machine (110) further includes a spout (118) extending external to housing (112) and/or hopper (116) for dispensing shaved ice from ice shaving machine (110), and a shaping device (or "former") (120) positioned below spout (118) in vertical alignment therewith for forming a dome-shaped top on the dispensed shaved ice. In other versions, at least a portion of former (120) may be laterally (i.e., circumferentially) offset from spout (118) such that an entirety of former (120) is not vertically aligned with spout (118). As described in greater detail below, ice shaving machine (110) of the present example is configured to produce shaved ice in response to actuation by the user of a movable structure defined by at least a portion of former (120) relative to housing (112).

Figure 2:
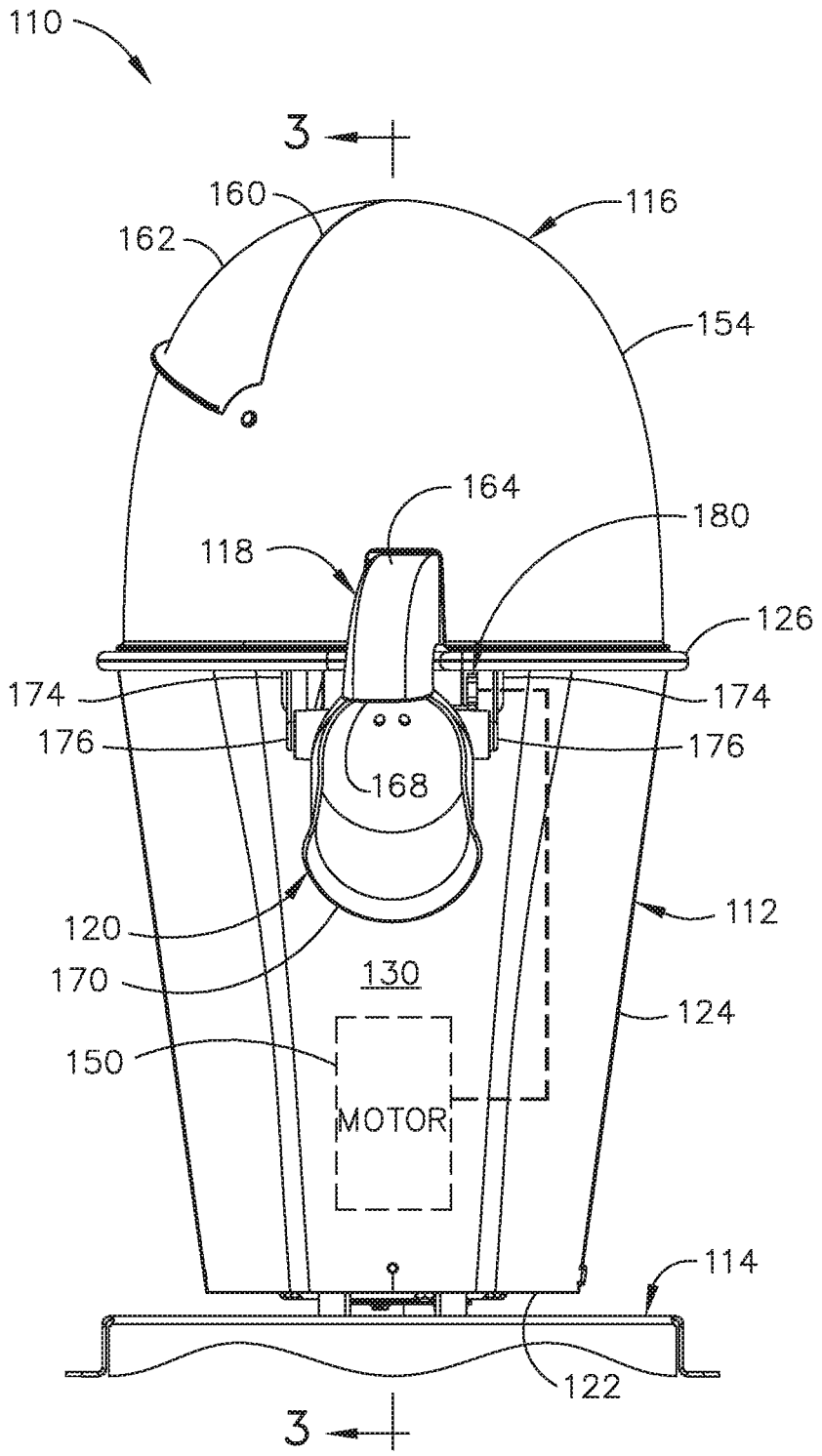
FIG. 2 depicts a front elevational view of the ice shaving machine of FIG. 1.
Figure 3:
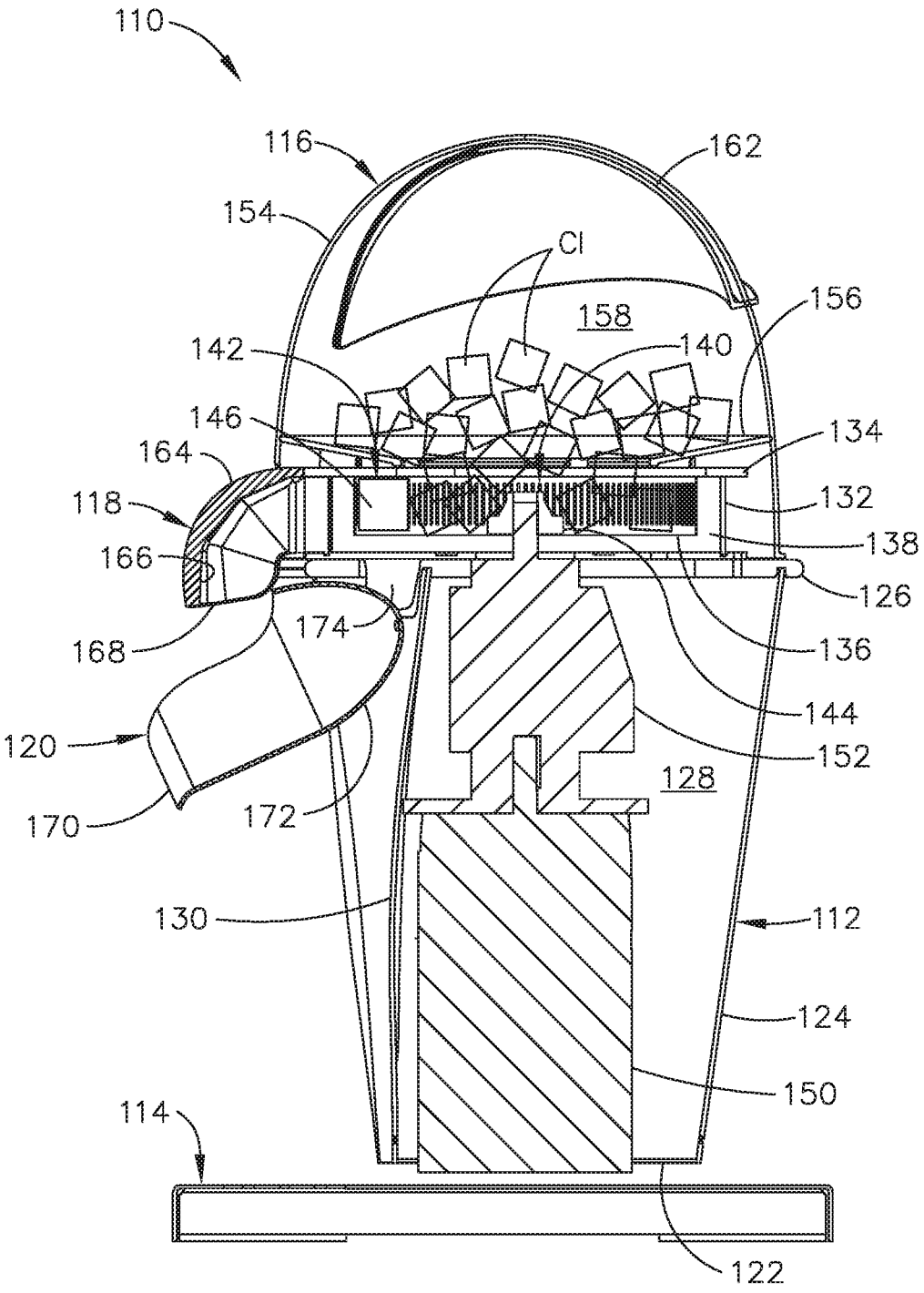
FIG. 3 depicts a cross sectional view of the ice shaving machine of FIG. 1, taken along section line 3-3 in FIG. 2.
Figure 4:
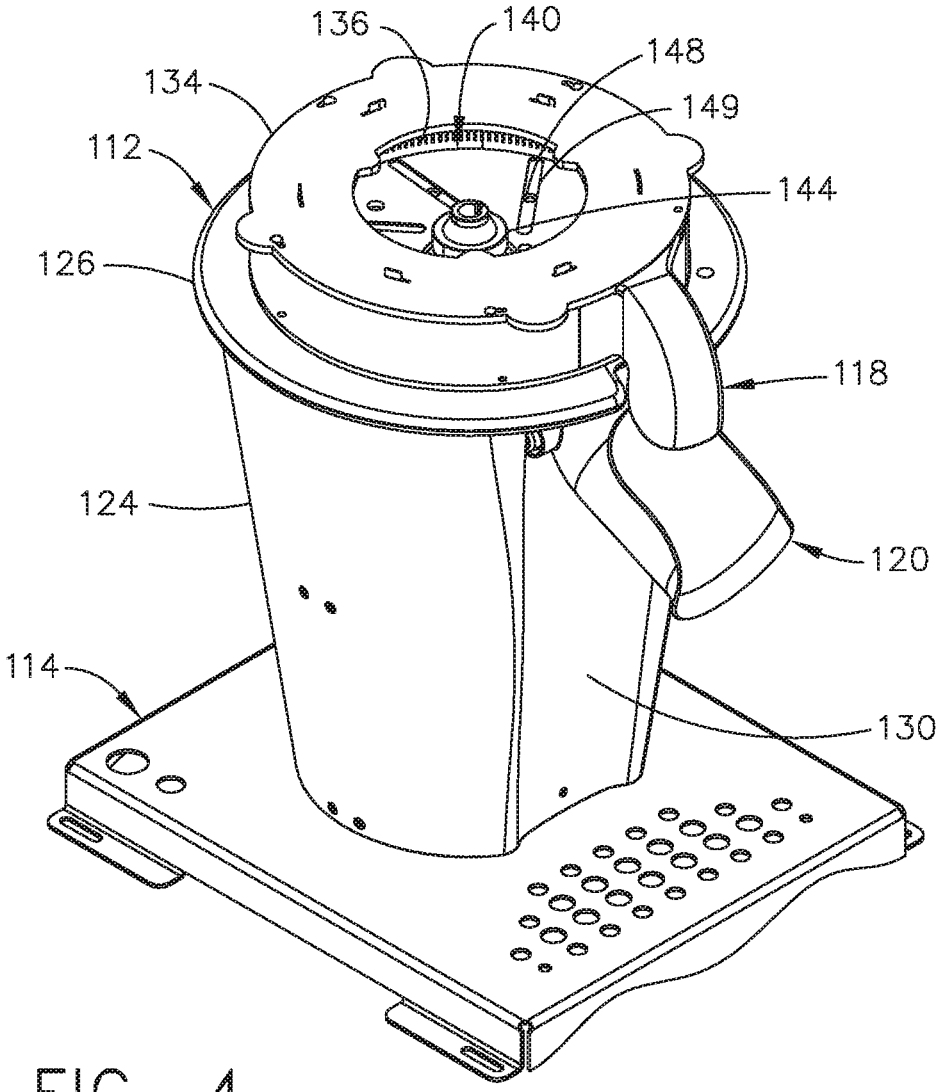
FIG. 4 depicts a perspective view of the ice shaving machine of FIG. 1, omitting a hopper of the ice shaving machine to reveal certain internal components of the ice shaving machine.

Referring primarily to FIGS. 2-4, housing (112) of the present example includes a base (122) and a generally frustoconical sidewall (124) extending upwardly from base (122) to an annular mounting plate (126), such that base (122), sidewall (124), and mounting plate (126) collectively define an interior cavity (128). In the example shown, sidewall (124) includes a front, rearwardly extending recess (130) for accommodating former (120). As best shown in FIG. 3, housing (112) further includes a stationary C-shaped wall (132) fixed to mounting plate (126) and extending upwardly therefrom to an annular upper platform (134). A stationary slotted annular blade (136) extends downwardly from upper platform (134) and is positioned radially inwardly relative to C-shaped wall (132) to define a generally annular cavity (138) therebetween for collecting shaved ice through slotted annular blade (136) and directing such shaved ice toward spout (118). In the example shown, a shaving compartment (140) is defined in the space radially inward of annular blade (136).

In this regard, a driven member in the form of a rotatable ice scraper wheel (142) is positioned radially inwardly relative to annular blade (136) within shaving compartment (140). Scraper wheel (142) includes a central hub (144) and at least one paddle (146) extending radially outwardly from hub (144) toward annular blade (136). In the example shown, scraper wheel (142) further includes a plurality of drain holes (148), at least a portion of which are positioned along respective drain grooves (149) for promoting drainage of melted ice from shaving compartment (140).

Scraper wheel (142) is rotatable relative to annular blade (136) for applying centrifugal force to ice within shaving compartment (140) to thereby urge such ice radially outwardly toward and through annular blade (136). Paddle (146) is configured to push such ice against annular blade (136) and toward annular cavity (138) during rotation of scraper wheel (142). In this manner, annular blade (136) and scraper wheel (142) may cooperate to produce shaved ice from ice within shaving compartment (140) and deposit such shaved ice into annular cavity (138).

In the example shown, scraper wheel (142) is configured to be selectively driven by a motor (150) positioned within interior cavity (128) of housing (112). More particularly, hub (144) of scraper wheel (142) is operatively coupled to motor (150) via a transmission assembly or gearbox (152), which is also positioned within interior cavity (128) of housing (112) and which extends upwardly from motor (150) through mounting plate (126) to hub (144). Thus, activation of motor (150) may effect rotation of scraper wheel (142), as described in greater detail below.

Hopper (116) of the present example includes a generally dome-shaped cap (154) and an annular funnel (156) which collectively define a loading chamber (158) for receiving ice, such as cubed ice (CI). In the example shown, hopper (116) further includes an aperture (160) provided in cap (154) and a door (162) pivotably coupled to cap (154) for selectively permitting access to loading chamber (158) via aperture (160), such as for loading cubed ice (CI) into loading chamber (158). As best shown in FIG. 3, loading chamber (158) of hopper (116) is generally axially aligned with and vertically above shaving compartment (140) of housing (112) when hopper (116) is attached to housing (112), such that cubed ice (CI) may be fed from loading chamber (158) downwardly into shaving compartment (140) via gravity for producing shaved ice.

Spout (118) of the present example includes a generally elbow-shaped conduit (164) including a passageway (166) which terminates at an outlet (168) positioned external to housing (112) and hopper (116). In the example shown, passageway (166) is in communication with annular cavity (138) for receiving shaved ice therefrom. Passageway (166) is bent downwardly at an approximately 90° angle for redirecting such shaved ice from a radially outward flow path to a vertically downward flow path to thereby dispense the shaved ice downwardly via outlet (168).

Former (120) of the present example includes an open-ended cup guide or cup support (170) and a closed-ended dome (172). Cup support (170) is configured to receive and guide a cup during dispensing of shaved ice into cup from spout (118) and during subsequent advancement of the cup along an inner surface of cup support (170) toward dome (172) by the user. Dome (172) is configured to mold or otherwise form a dome-shaped top on the dispensed shaved ice when the cup is advanced toward dome (172) to pack the dispensed shaved ice against an inner surface of dome (172). In the example shown, cup support (170) and dome (172) are integrally formed together as a unitary piece. In other examples, cup support (170) and dome (172) may be separately formed from each other as distinct pieces, as described below. It will be appreciated that former (120) may be alternatively configured in other versions to shape the dispensed shaved ice with any desired predetermined shape.

Figure 5A:
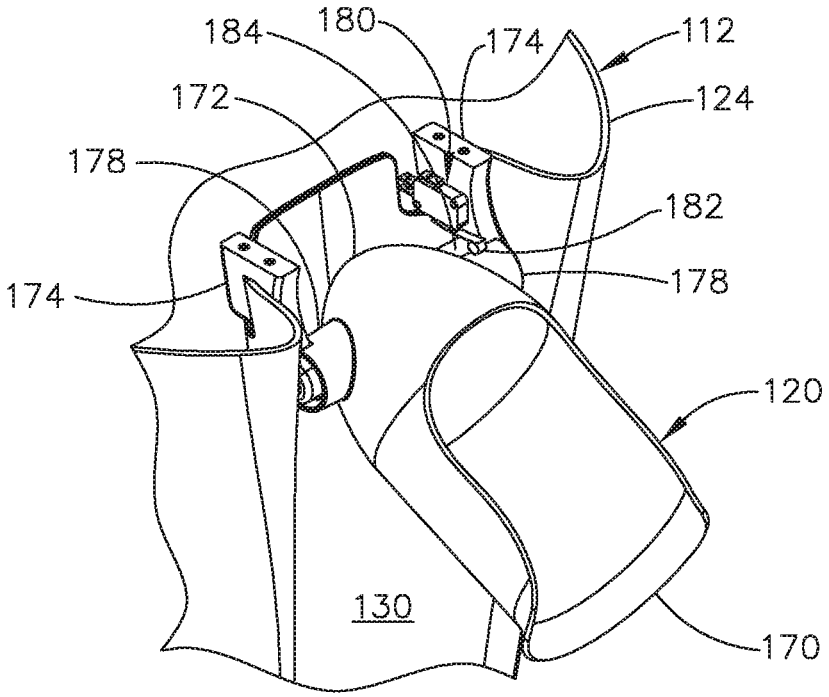
FIG. 5A depicts an enlarged perspective view of a portion of the ice shaving machine of FIG. 1, showing a former of the ice shaving machine in an unactuated state, and further showing a switch of the ice shaving machine in a deactivation state.
Figure 5B:
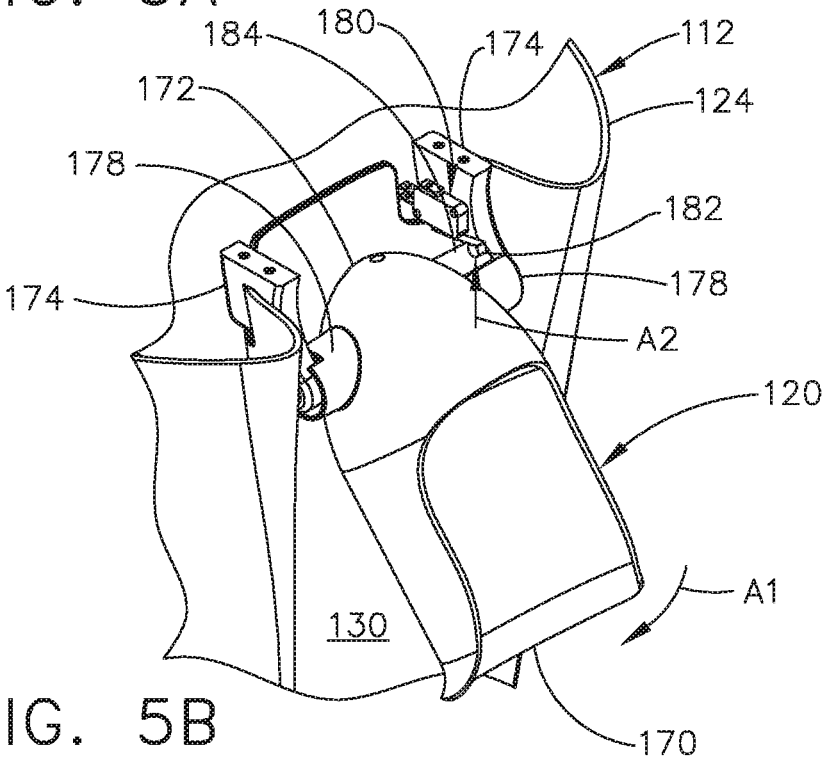
FIG. 5B depicts an enlarged perspective view of a portion of the ice shaving machine of FIG. 1, showing the former of the ice shaving machine in an actuated state, and further showing the switch of the ice shaving machine in an activation state.

Referring now primarily to FIGS. 5A and 5B, former (120) of the present example is pivotably coupled to housing (112) such that former (120) is pivotable relative to housing (112) between an unactuated state (also referred to herein as an "untriggered state") (FIG. 5A) and an actuated state (also referred to herein as a "triggered state") (FIG. 5B). More particularly, a pair of pivot arms (174) are fixed to opposing sides of recess (130) of housing (112) and pivotably retain respective pivot pins (176) (FIG. 2) extending laterally outwardly from dome (172) of former (120) within respective sleeves (178). Former (120) may be resiliently biased toward the untriggered state, such as via a torsion spring or any other suitable biasing member (not shown). In one example, motor (150) is configured to drive scraper wheel (142) in response to pivoting of former (120) relative to housing (112) from the untriggered state to the triggered state.

In this regard, a switch shown in the form of an electromechanical switch (180) is positioned on one pivot arm (174) and is in operative communication with motor (150) for activating motor (150) in response to pivoting of former (120) relative to housing (112) from the untriggered state to the triggered state. More particularly, former (120) is configured to actuate switch (180) when former (120) is pivoted from the untriggered state to the triggered state. To this end, switch (180) of the present example includes a resiliently-biased actuator (182), and former (120) includes a raised camming surface (184) extending radially outwardly from the respective sleeve (178) for selectively engaging actuator (182) during pivoting of former (120) from the untriggered state to the triggered state. Thus, pivoting of former (120) from the untriggered state to the triggered state, as indicated by first arrow (A1) in FIG. 5B, may cause camming surface (184) to apply a threshold force sufficient to urge actuator (182) upwardly, as indicated by second arrow (A2) in FIG. 5B, to thereby transition switch (180) from an unactuated, deactivation state to an actuated, activation state in which switch (180) activates motor (150) to rotate scraper wheel (142). In one example, the resilient biasing of actuator (182) may enable switch (180) to automatically transition from the activation state to the deactivation state upon removal of the threshold force applied by camming surface (184) to actuator (182), such as during pivoting of former (120) from the triggered state to the untriggered state, to deactivate motor (150) and cease rotating scraper wheel (142).

Figure 6A:
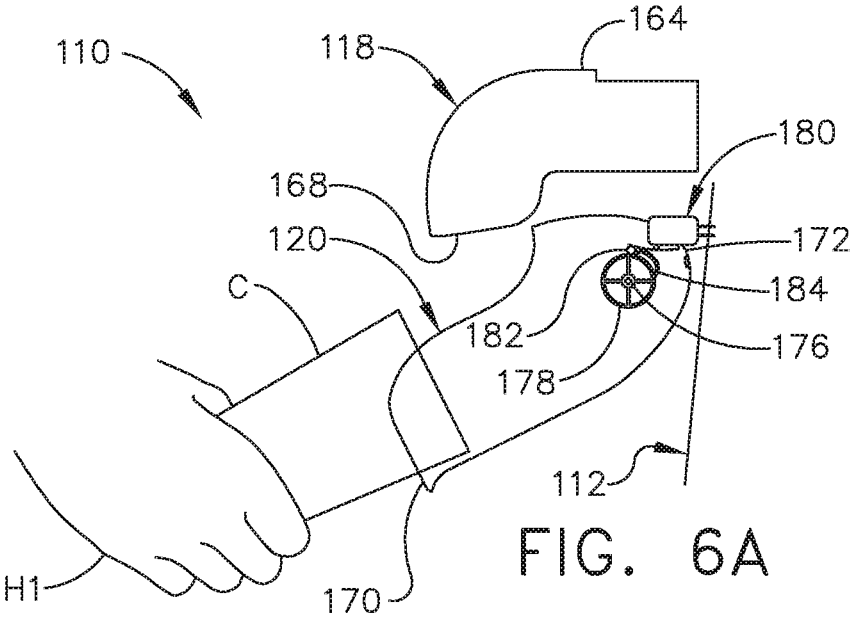
FIG. 6A depicts a schematic side elevational view of a portion of the ice shaving machine of FIG. 1, showing a user inserting a cup into a cup support of the former, and further showing the former and the switch in the unactuated and deactivation states, respectively.
Figure 6B:
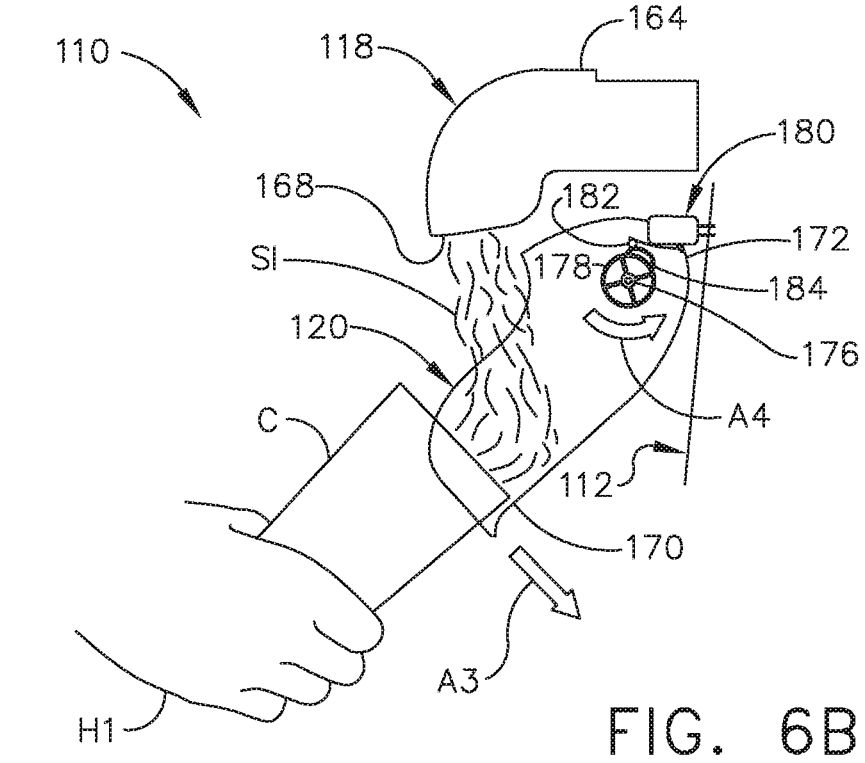
FIG. 6B depicts a schematic side elevational view of a portion of the ice shaving machine of FIG. 1, showing the user pressing the cup against the cup support of the former to pivot the former from the unactuated state toward the actuated state to thereby transition the switch from the deactivation state toward the activation state for dispensing shaved ice into the cup via a spout of the ice shaving machine.
Figure 6C:
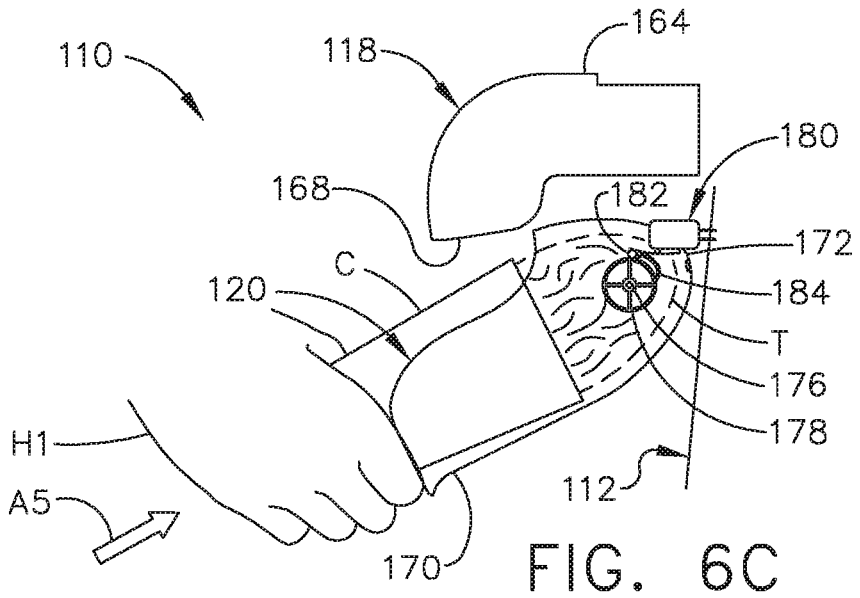
FIG. 6C depicts a schematic side elevational view of a portion of the ice shaving machine of FIG. 1, showing the former and the switch returned to the unactuated and deactivation states, respectively, and further showing the user advancing the cup toward the dome of the former to thereby form a dome-shaped top on the dispensed shaved ice.
Figure 6D:
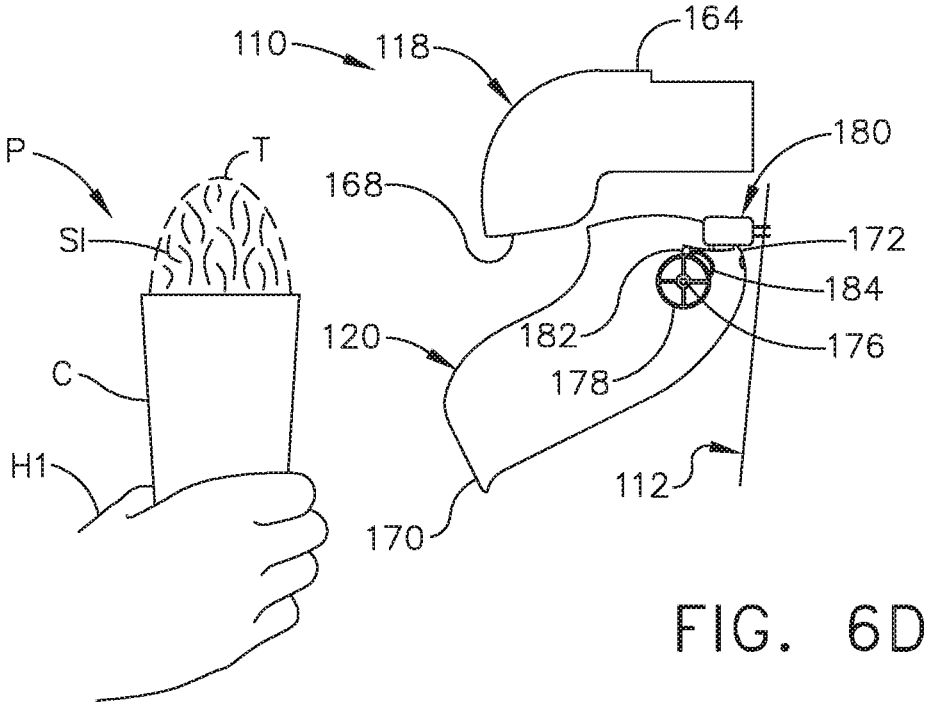
FIG. 6D depicts a schematic side elevational view of a portion of the ice shaving machine of FIG. 1, showing the user having withdrawn the cup from the former to produce a shaved ice product, and further showing the former and the switch remaining in the unactuated and deactivation states, respectively.

Referring now to FIGS. 6A-6D, exemplary operation of ice shaving machine (110) to produce a shaved ice product (P) from cubed ice (CI) is shown. First, a user may insert a cup (C) into cup support (170) of former (120) with the user's first hand (H1), with former (120) initially in the untriggered state such that switch (180) is in the deactivation state, as shown in FIG. 6A. The user may subsequently press the cup (C) against an inner surface of cup support (170), as indicated by third arrow (A3) in FIG. 6B, to pivot former (120) in a counterclockwise direction (based on the frame of reference in FIGS. 6A-6D) from the untriggered state toward the triggered state, as indicated by fourth arrow (A4) in FIG. 6B. In response to such pivoting of former (120) from the untriggered state toward the triggered state, camming surface (184) may urge actuator (182) upwardly to thereby transition switch (180) from the deactivation state toward the activation state to activate motor (150) for dispensing shaved ice (SI) into the cup (C) via spout (118), as shown in FIG. 6B. When a desired amount of shaved ice (SI) has been dispensed into the cup (C), the user may cease pressing the cup (C) against the inner surface of cup support (170) to allow former (120) and switch (180) to return to the untriggered and deactivation states, respectively, for ceasing dispensing shaved ice (SI) into the cup (C). The user may then advance the cup (C) toward dome (172) of former (120) to thereby form a dome-shaped top (T) on the dispensed shaved ice (SI), as indicated by fifth arrow (A5) in FIG. 6C. Finally, the user may withdraw the cup (C) from former (120) to produce a shaved ice product (P) ready for flavoring while former (120) and switch (180) remain in the untriggered and deactivation states, respectively, as shown in FIG. 6D.

While only one switch (180) is shown in the present example, it will be appreciated that any suitable quantity and arrangement of two or more switches (180) may be provided in other examples. In such configurations, each switch (180) may be configured to detect a corresponding one or more respective positions of the movable structure (e.g., former (120)) relative to housing (112) or another portion of ice shaving machine (110). Such multiple switches (180) may be positioned on ice shaving machine (110) in a variety of suitable locations in addition to or in place of the location shown and described herein, such that switches (180) are operable in the manner described herein. Additionally, while switch (180) is shown in the form of an actuatable electromechanical switch that is directly contacted by a movable structure of ice shaving machine (110), it will be appreciated that switch (180) may be any suitable type of electrical switch readily apparent to those of ordinary skill in the art in view of the teachings herein, including both contact switches and contactless switches. For instance, and by way of example only, switch (180) may alternatively be in the form of a magnetic switch, a pressure switch, a membrane switch, an inductive proximity sensor switch, a photoelectric sensor switch, or the like. In versions incorporating a contactless switch, it will be appreciated that the mere presence of a certain object (e.g., a cup), without actuating a movable structure, may be effective to trigger the contactless switch and thereby activate motor (150) for generating shaved ice. It will be further appreciated that such exemplary variations in the quantity, arrangement, and/or type of switch (180) may similarly apply to switches (280, 380, 480, 580, 680, 780, 880, 980, 1080, 1180) described below.

B. Exemplary Ice Shaving Machine Having Upwardly Translatable Former

Figure 7:
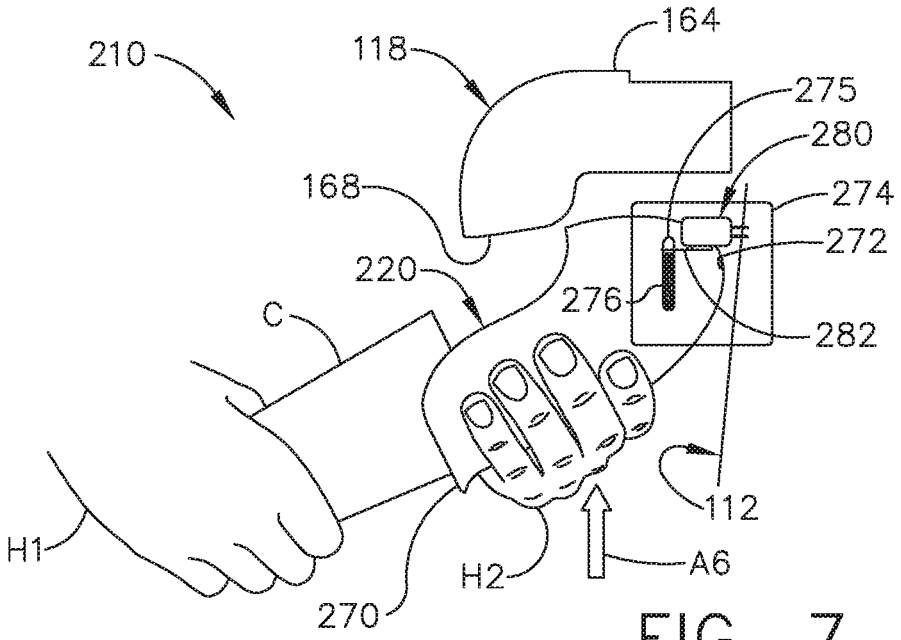
FIG. 7 depicts a schematic side elevational view of a portion of another exemplary ice shaving machine, showing a user inserting a cup into a cup support of a former of the ice shaving machine, and further showing the user lifting the former to translate the former in an upward direction from an unactuated state toward an actuated state to thereby transition a switch of the ice shaving machine from a deactivation state toward an activation state.

FIG. 7 shows another exemplary ice shaving machine (210) configured to produce shaved ice in response to user-actuation of a movable structure defined by at least a portion of a former of the ice shaving machine (210). Ice shaving machine (210) is similar to ice shaving machine (110) described above except as otherwise described below.

Ice shaving machine (210) of this example comprises housing (112), spout (118), and a former (220) positioned below spout (118) in vertical alignment therewith for forming a dome-shaped top on the dispensed shaved ice. In other versions, at least a portion of former (220) may be laterally offset from spout (118)

Former (220) of the present example includes an open-ended cup guide or cup support (270) and a closed-ended dome (272), and is translatably coupled to housing (112) such that former (220) is translatable relative to housing (112) between the illustrated untriggered state and a triggered state. More particularly, at least one bracket (274) is fixed to housing (112) and includes at least one slot (275) which slidably retains at least one respective rail (276) extending laterally outwardly from dome (272) of former (220). Former (220) may be resiliently biased toward the untriggered state, such as via a tension or compression spring or any other suitable biasing member (not shown). In one example, motor (150) is configured to drive scraper wheel (142) in response to upward translation of former (220) relative to housing (112) from the untriggered state to the triggered state.

In this regard, a switch shown in the form of an electromechanical switch (280) is positioned on bracket (274) and is in operative communication with motor (150) for activating motor (150) in response to upward translation of former (220) relative to housing (112) from the untriggered state to the triggered state. More particularly, former (220) is configured to actuate switch (280) when former (220) is translated upwardly from the untriggered state to the triggered state. To this end, switch (280) of the present example includes a resiliently-biased actuator (282), and rail (276) of former (220) includes an upper surface for selectively engaging actuator (282) during upward translation of former (220) from the untriggered state to the triggered state. Thus, upward translation of former (220) from the untriggered state to the triggered state may cause the upper surface of rail (276) to apply a threshold force sufficient to urge actuator (282) upwardly, to thereby transition switch (280) from an unactuated, deactivation state to an actuated, activation state in which switch (280) activates motor (150) to rotate scraper wheel (142). In one example, the resilient biasing of actuator (282) may enable switch (280) to automatically transition from the activation state to the deactivation state upon removal of the threshold force applied by the upper surface of rail (276) to actuator (282), such as during downward translation of former (220) from the triggered state to the untriggered state, to deactivate motor (150) and cease rotating scraper wheel (142).

During operation, a user may insert a cup (C) into cup support (270) of former (220) with the user's first hand (H1) and may subsequently lift former (220) with the user's second hand (H2) to translate former (220) in an upward direction from the untriggered state toward the triggered state, as indicated by sixth arrow (A6) in FIG. 7. This action transitions switch (280) to the activation state to thereby activate motor (150) and dispense shaved ice (SI) into cup (C).

C. Exemplary Ice Shaving Machine Having Downwardly Translatable Former

Figure 8:
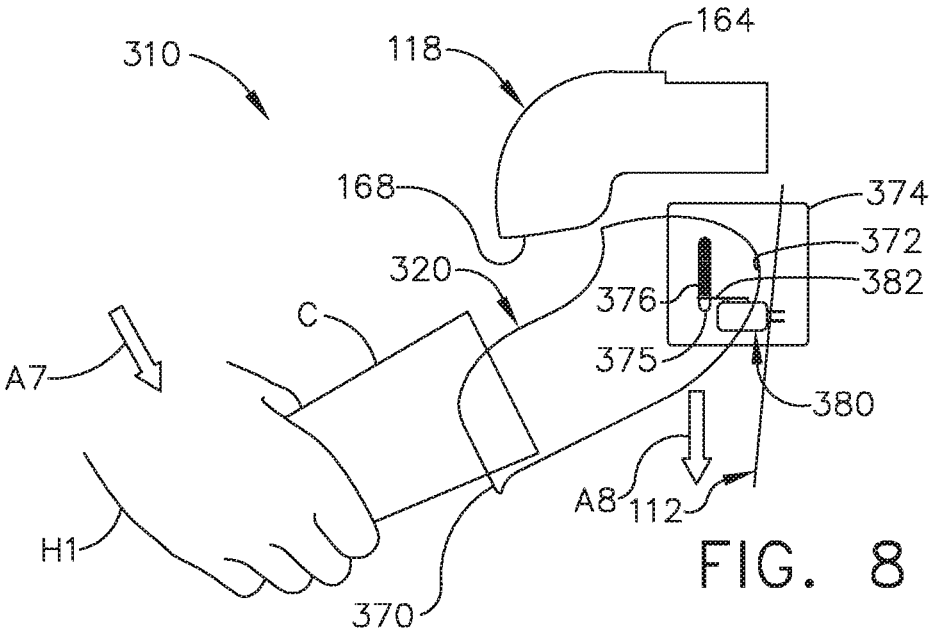
FIG. 8 depicts a schematic side elevational view of a portion of another exemplary ice shaving machine, showing a user inserting a cup into a cup support of a former of the ice shaving machine, and further showing the user pressing the cup against the cup support of the former to translate the former in a downward direction from an unactuated state toward an actuated state to thereby transition a switch of the ice shaving machine from a deactivation state toward an activation state.

FIG. 8 shows another exemplary ice shaving machine (310) configured to produce shaved ice in response to user-actuation of a movable structure defined by at least a portion of a former of the ice shaving machine (310). Ice shaving machine (310) is similar to ice shaving machine (110) described above except as otherwise described below.

Ice shaving machine (310) of this example comprises housing (112), spout (118), and a former (320) positioned below spout (118) in vertical alignment therewith for forming a dome-shaped top on the dispensed shaved ice. In other versions, at least a portion of former (320) may be laterally offset from spout (118).

Former (320) of the present example includes an open-ended cup guide or cup support (370) and a closed-ended dome (372), and is translatably coupled to housing (112) such that former (320) is translatable relative to housing (112) between the illustrated untriggered state and a triggered state. More particularly, at least one bracket (374) is fixed to housing (112) and includes at least one slot (375) which slidably retains at least one respective rail (376) extending laterally outwardly from dome (372) of former (320). Former (320) may be resiliently biased toward the untriggered state, such as via a tension or compression spring or any other suitable biasing member (not shown). In one example, motor (150) is configured to drive scraper wheel (142) in response to downward translation of former (320) relative to housing (112) from the untriggered state to the triggered state.

In this regard, a switch shown in the form of an electromechanical switch (380) is positioned on bracket (374) and is in operative communication with motor (150) for activating motor (150) in response to downward translation of former (320) relative to housing (112) from the untriggered state to the triggered state. More particularly, former (320) is configured to actuate switch (380) when former (320) is translated downwardly from the untriggered state to the triggered state. To this end, switch (380) of the present example includes a resiliently-biased actuator (382), and rail (376) of former (320) includes a lower surface for selectively engaging actuator (382) during downward translation of former (320) from the untriggered state to the triggered state. Thus, downward translation of former (320) from the untriggered state to the triggered state may cause the lower surface of rail (376) to apply a threshold force sufficient to urge actuator (382) downwardly, to thereby transition switch (380) from an unactuated, deactivation state to an actuated, activation state in which switch (380) activates motor (150) to rotate scraper wheel (142). In one example, the resilient biasing of actuator (382) may enable switch (380) to automatically transition from the activation state to the deactivation state upon removal of the threshold force applied by the lower surface of rail (376) to actuator (382), such as during upward translation of former (320) from the triggered state to the untriggered state, to deactivate motor (150) and cease rotating scraper wheel (142).

During operation, a user may insert a cup (C) into cup support (370) of former (320) with the user's first hand (H1) and may subsequently press the cup (C) against an inner surface of cup support (370), as indicated by seventh arrow (A7) in FIG. 8, to translate former (320) in a downward direction from the untriggered state toward the triggered state, as indicated by eighth arrow (A8) in FIG. 8. This action transitions switch (380) to the activation state to thereby activate motor (150) and dispense shaved ice (SI) into cup (C).

Figure 9A:
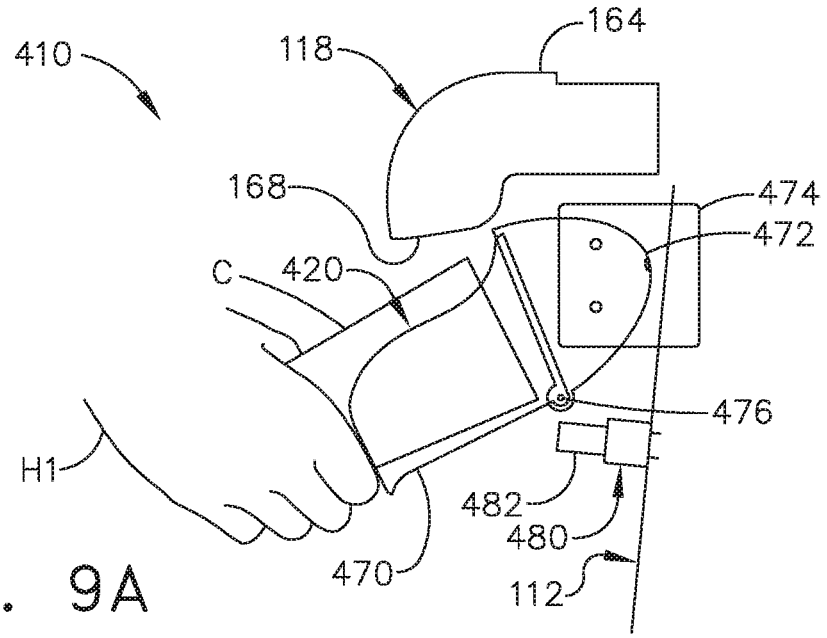
FIG. 9A depicts a schematic side elevational view of a portion of another exemplary ice shaving machine, showing a user inserting a cup into a cup support of a former of the ice shaving machine, and further showing a pivotable portion of the former in an unactuated state and a switch of the ice shaving machine in a deactivation state.
Figure 9B:
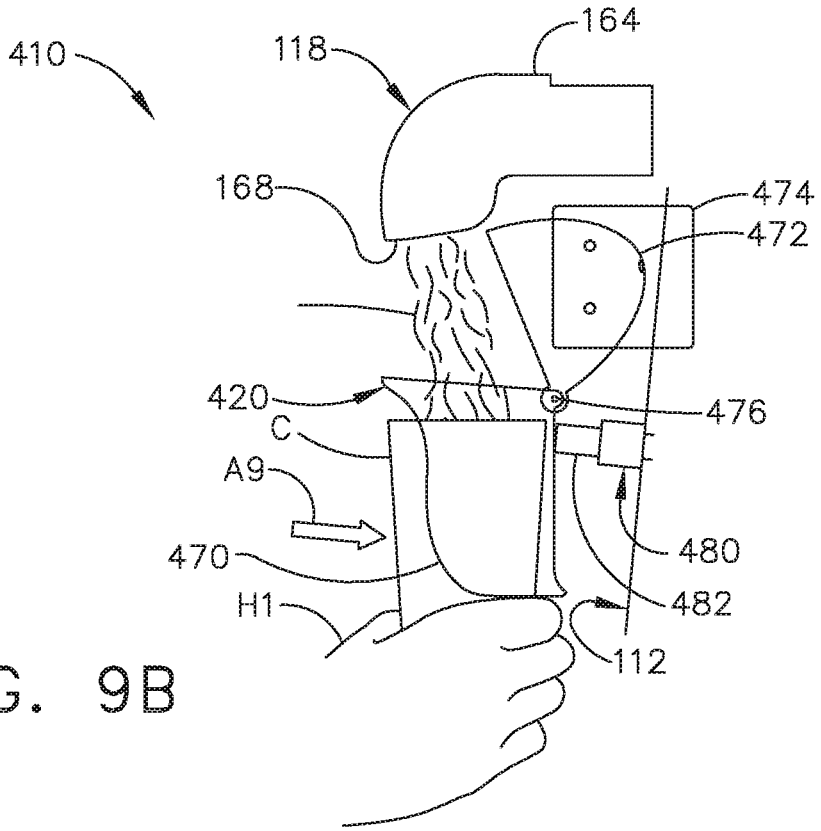
FIG. 9B depicts a schematic side elevational view of the portion of the ice shaving machine of FIG. 9A, showing the user pressing the cup against the cup support of the former to pivot the pivotable portion of the former from the unactuated state toward an actuated state to thereby transition the switch of the ice shaving machine from the deactivation state toward an activation state for dispensing shaved ice into the cup via a spout of the ice shaving machine.

D. Exemplary Ice Shaving Machine Having Former with Fixed and Pivotable Portions FIGS. 9A-9B show another exemplary ice shaving machine (410) configured to produce shaved ice in response to user-actuation of a movable structure defined by at least a portion of a former of the ice shaving machine (410). Ice shaving machine (410) is similar to ice shaving machine (110) described above except as otherwise described below.

Ice shaving machine (410) of this example comprises housing (112), spout (118), and a former (420) positioned below spout (118) in vertical alignment therewith for forming a dome-shaped top on the dispensed shaved ice. In other versions, at least a portion of former (420) may be laterally offset from spout (118).

Former (420) of the present example includes an open-ended cup guide or cup support (470) and a closed-ended dome (472). In the example shown, cup support (470) is pivotably coupled to dome (472), and dome (472) is fixedly coupled to housing (112) via a bracket (474) such that cup support (470) is pivotable relative to housing (112) between an untriggered state (FIG. 9A) and a triggered state (FIG. 9B). More particularly, a pivot pin (476) pivotably couples cup support (470) to dome (472). Cup support (470) may be resiliently biased toward the untriggered state, such as via a torsion spring or any other suitable biasing member (not shown). In one example, motor (150) is configured to drive scraper wheel (142) in response to pivoting of cup support (470) relative to housing (112) from the untriggered state to the triggered state.

In this regard, a switch shown in the form of an electromechanical switch (480) is positioned on an outer surface of housing (112) and is in operative communication with motor (150) for activating motor (150) in response to pivoting of cup support (470) relative to housing (112) from the untriggered state to the triggered state. More particularly, cup support (470) is configured to actuate switch (480) when cup support (470) is pivoted from the untriggered state to the triggered state. To this end, switch (480) of the present example includes a resiliently-biased actuator in the form of a button (482), and cup support (470) includes an outer surface for selectively engaging button (482) during pivoting of cup support (470) from the untriggered state to the triggered state. Thus, pivoting of cup support (470) from the untriggered state to the triggered state may cause the outer surface of cup support (470) to apply a threshold force sufficient to depress button (482), to thereby transition switch (480) from an unactuated, deactivation state to an actuated, activation state in which switch (480) activates motor (150) to rotate scraper wheel (142). In one example, the resilient biasing of button (482) may enable switch (480) to automatically transition from the activation state to the deactivation state upon removal of the threshold force applied by the outer surface of cup support (470) to button (482), such as during pivoting of cup support (470) from the triggered state to the untriggered state, to deactivate motor (150) and cease rotating scraper wheel (142).

During operation, a user may insert a cup (C) into cup support (470) of former (420) with the user's first hand (H1) and may subsequently press the cup (C) against an inner surface of cup support (470), as indicated by ninth arrow (A9) in FIG. 9B, to pivot cup support (470) in a counterclockwise direction (based on the frame of reference in FIGS. 9A-9B) from the untriggered state toward the triggered state for dispensing shaved ice (SI) into the cup (C) via spout (118), as shown in FIG. 9B.

E. Exemplary Ice Shaving Machine Having Former with Button

Figure 10:
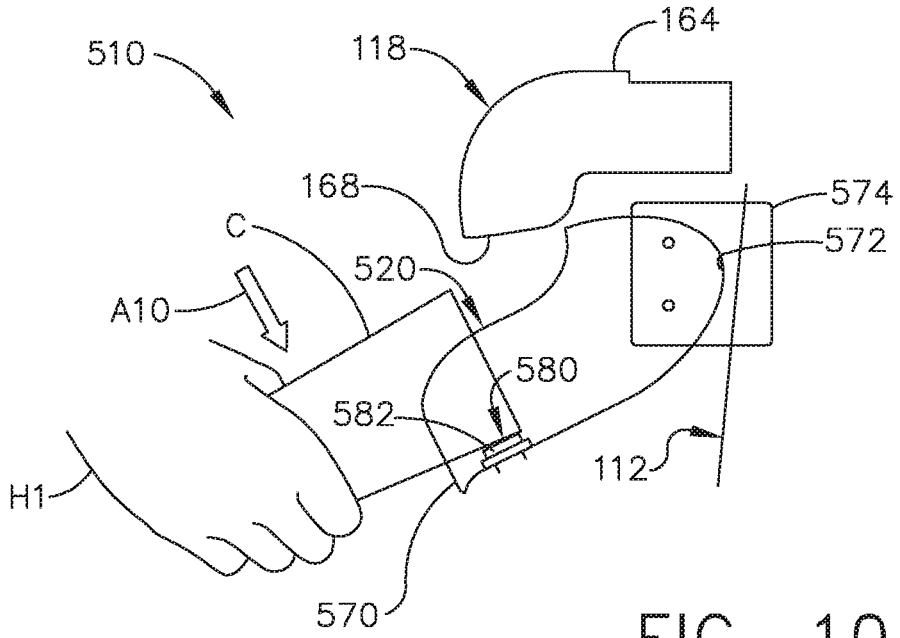
FIG. 10 depicts a schematic side elevational view of a portion of another exemplary ice shaving machine, showing a user inserting a cup into a cup support of a former of the ice shaving machine, and further showing the user pressing the cup against a button of a switch presented by the former to thereby transition the switch from a deactivation state toward an activation state.

FIG. 10 shows another exemplary ice shaving machine (510) configured to produce shaved ice in response to user-actuation of a movable structure defined by at least a portion of a former of the ice shaving machine (510). Ice shaving machine (510) is similar to ice shaving machine (110) described above except as otherwise described below.

Ice shaving machine (510) of this example comprises housing (112), spout (118), and a former (520) positioned below spout (118) in vertical alignment therewith for forming a dome-shaped top on the dispensed shaved ice. In other versions, at least a portion of former (520) may be laterally offset from spout (118).

Former (520) of the present example includes an open-ended cup guide or cup support (570) and a closed-ended dome (572). In the example shown, cup support (570) and dome (572) are fixedly coupled to housing (112) via a bracket (574) and a switch shown in the form of an electromechanical switch (580) is positioned on an inner surface of cup support (570) such that a resiliently-biased button (582) of switch (580) is depressible relative to housing (112) between the illustrated untriggered state and a triggered state. In one example, motor (150) is configured to drive scraper wheel (142) in response to depressing of button (582) relative to housing (112) from the untriggered state to the triggered state. In this regard, switch (580) is in operative communication with motor (150) for activating motor (150) in response to depressing of button (582) relative to housing (112) from the untriggered state to the triggered state.

During operation, a user may insert a cup (C) into cup support (570) of former (520) with the user's first hand (H1) and may subsequently press the cup (C) against button (582), as indicated by tenth arrow (A10) in FIG. 10, to depress button (582) from the untriggered state toward the triggered state. This action transitions switch (580) to the activation state to thereby activate motor (150) and dispense shaved ice (SI) into cup (C).

F. Exemplary Ice Shaving Machine Having Pivotable Spout

In some instances, it may be desirable to provide a motor-activation switch independently of a shaping device (or "former") of the corresponding ice shaving machine. It will be appreciated that in some such versions, the former may be provided separately from the ice shaving machine. By way of example only, the former may be an independent handheld device; the former may be attached to a support structure that is separate and independent from the ice shaving machine; or the former may be omitted from use entirely. It will be appreciated that in any such versions, each of (i) an ice shaving machine without a former, and (ii) the combination of an ice shaving machine with an independent former, may be considered an "ice shaving system." FIGS. 11-13 described below illustrate exemplary ice shaving machines (or "systems") (610, 710, 810) in which a motor-activation switch is functionally independent of the corresponding former (620). Thus, it will be appreciated that in some instances, former (620) may be provided independently from housing (112), or otherwise omitted from use entirely, without affecting functionality of the motor-activation switch (680, 780, 880) of the respective ice shaving system (610, 710, 810).

Figure 11:
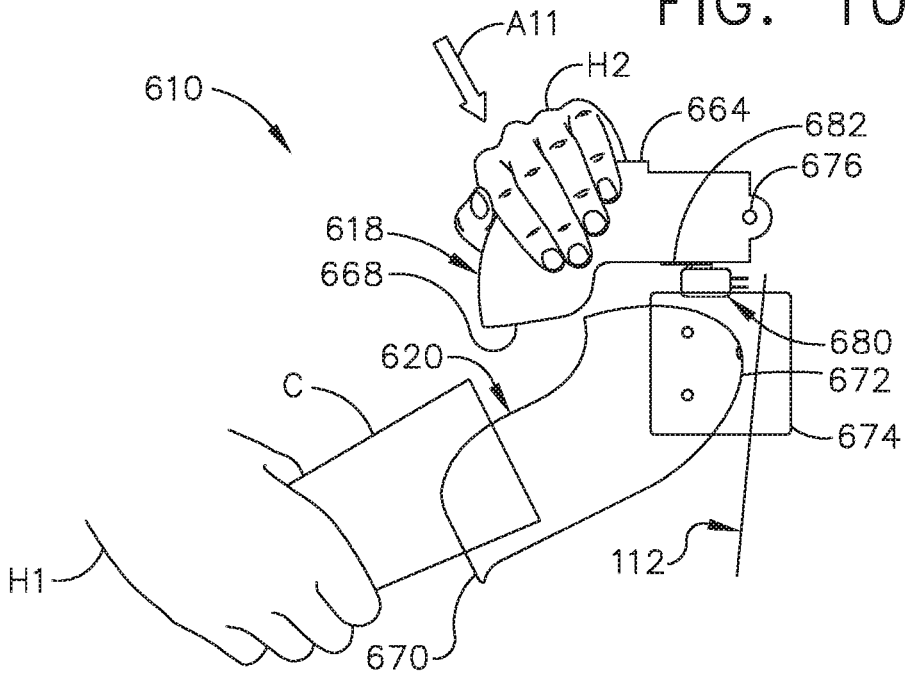
FIG. 11 depicts a schematic side elevational view of a portion of another exemplary ice shaving machine, showing a user inserting a cup into a cup support of a former of the ice shaving machine, and further showing the user pressing against a spout of the ice shaving machine to pivot the spout from an unactuated state toward an actuated state to thereby transition a switch of the ice shaving machine from a deactivation state toward an activation state.

FIG. 11 shows another exemplary ice shaving machine (610) configured to produce shaved ice in response to user-actuation of a movable structure defined by at least a portion of a spout of the ice shaving machine (610). Ice shaving machine (610) is similar to ice shaving machine (110) described above except as otherwise described below.

Ice shaving machine (610) of this example comprises housing (112), a spout (618) extending external to housing (112) and/or hopper (116) for dispensing shaved ice from ice shaving machine (610), and a former (620) positioned below spout (618) in vertical alignment therewith for forming a dome-shaped top on the dispensed shaved ice. In other versions, at least a portion of former (620) may be laterally offset from spout (618).

Spout (618) of the present example includes a generally elbow-shaped conduit (664) including a passageway (not shown) which terminates at an outlet (668) positioned external to housing (112) and hopper (116). The passageway of conduit (664) may be in communication with annular cavity (138) for receiving shaved ice therefrom, and may be bent downwardly at an approximately 90° angle for redirecting such shaved ice from a radially outward flow path to a vertically downward flow path to thereby dispense the shaved ice downwardly via outlet (668). Former (620) of the present example includes an open-ended cup guide or cup support (670) and a closed-ended dome (672) fixedly coupled to housing (112) via a bracket (674). In the example shown, spout (618) is pivotably coupled to housing (112) such that spout (618) is pivotable relative to housing (112) between the illustrated untriggered state and a triggered state. More particularly, a pivot pin (676) pivotably couples an end of spout (618) opposite from outlet (668) to housing (112). Spout (618) may be resiliently biased toward the untriggered state, such as via a torsion spring or any other suitable biasing member (not shown). In one example, motor (150) is configured to drive scraper wheel (142) in response to pivoting of spout (618) relative to housing (112) from the untriggered state to the triggered state.

In this regard, a switch shown in the form of an electromechanical switch (680) is positioned on bracket (674) and is in operative communication with motor (150) for activating motor (150) in response to pivoting of spout (618) relative to housing (112) from the untriggered state to the triggered state. More particularly, spout (618) is configured to actuate switch (680) when spout (618) is pivoted from the untriggered state to the triggered state. To this end, switch (680) of the present example includes a resiliently-biased actuator (682), and conduit (664) of spout (618) includes a lower surface for selectively engaging actuator (682) during pivoting of spout (618) from the untriggered state to the triggered state. Thus, pivoting of spout (618) from the untriggered state to the triggered state may cause the lower surface of conduit (664) to apply a threshold force sufficient to urge actuator (682) downwardly, to thereby transition switch (680) from an unactuated, deactivation state to an actuated, activation state in which switch (680) activates motor (150) to rotate scraper wheel (142). In one example, the resilient biasing of actuator (682) may enable switch (680) to automatically transition from the activation state to the deactivation state upon removal of the threshold force applied by the lower surface of conduit (664) to actuator (682), such as during pivoting of spout (618) from the triggered state to the untriggered state, to deactivate motor (150) and cease rotating scraper wheel (142).

During operation, a user may insert a cup (C) into former (620) with the user's first hand (H1) and may subsequently press spout (618) with the user's second hand (H2), as indicated by eleventh arrow (A11) in FIG. 11, to pivot spout (618) in a counterclockwise direction (based on the frame of reference in FIG. 11) from the untriggered state toward the triggered state. This action transitions switch (680) to the activation state to thereby activate motor (150) and dispense shaved ice (SI) into cup (C).

G. Exemplary Ice Shaving Machine Having Upwardly Translatable Spout

Figure 12:
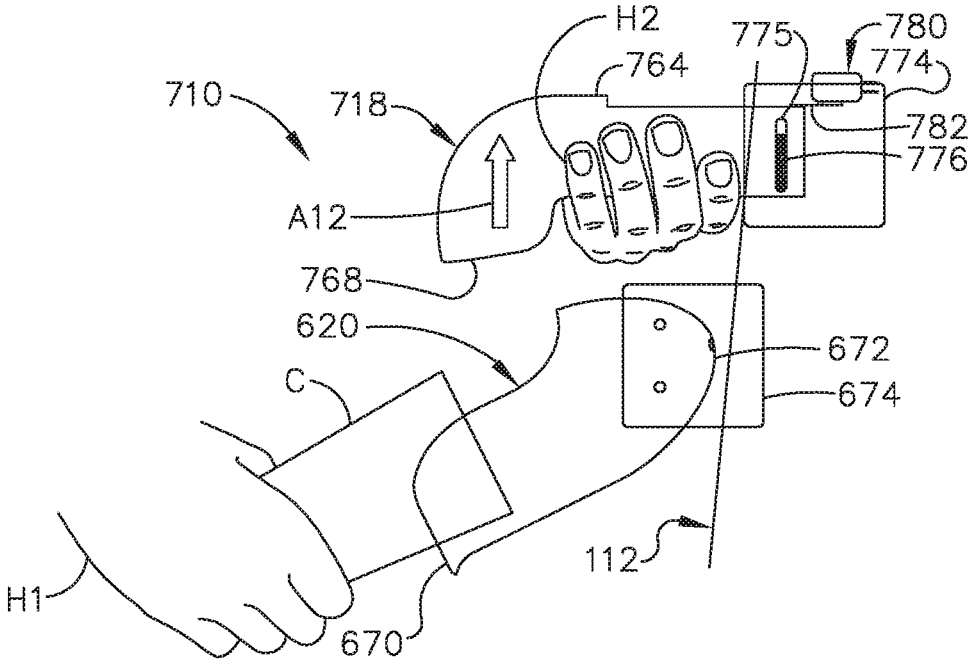
FIG. 12 depicts a schematic side elevational view of a portion of another exemplary ice shaving machine, showing a user inserting a cup into a cup support of a former of the ice shaving machine, and further showing the user lifting a spout of the ice shaving machine to translate the spout in an upward direction from an unactuated state toward an actuated state to thereby transition a switch of the ice shaving machine from a deactivation state toward an activation state.

FIG. 12 shows another exemplary ice shaving machine (710) configured to produce shaved ice in response to user-actuation of a movable structure defined by at least a portion of a spout of the ice shaving machine (710). Ice shaving machine (710) is similar to ice shaving machine (110) described above except as otherwise described below.

Ice shaving machine (710) of this example comprises housing (112), a spout (718) extending external to housing (112) and/or hopper (116) for dispensing shaved ice from ice shaving machine (710), and former (620).

Spout (718) of the present example includes a generally elbow-shaped conduit (764) including a passageway (not shown) which terminates at an outlet (768) positioned external to housing (112) and hopper (116). The passageway of conduit (764) may be in communication with annular cavity (138) for receiving shaved ice therefrom, and may be bent downwardly at an approximately 90° angle for redirecting such shaved ice from a radially outward flow path to a vertically downward flow path to thereby dispense the shaved ice downwardly via outlet (768). In the example shown, spout (718) is translatably coupled to housing (112) such that spout (718) is translatable relative to housing (112) between the illustrated untriggered state and a triggered state. More particularly, at least one bracket (774) is fixed to housing (112) and includes at least one slot (775) which slidably retains at least one respective rail (776) extending laterally outwardly from conduit (764) of spout (718). Spout (718) may be resiliently biased toward the untriggered state, such as via a tension or compression spring or any other suitable biasing member (not shown). In one example, motor (150) is configured to drive scraper wheel (142) in response to upward translation of spout (718) relative to housing (112) from the untriggered state to the triggered state.

In this regard, a switch shown in the form of an electromechanical switch (780) is positioned on bracket (774), and is in operative communication with motor (150) for activating motor (150) in response to upward translation of spout (718) relative to housing (112) from the untriggered state to the triggered state. More particularly, spout (718) is configured to actuate switch (780) when spout (718) is translated upwardly from the untriggered state to the triggered state. To this end, switch (780) of the present example includes a resiliently-biased actuator (782), and rail (776) of spout (718) includes an upper surface for selectively engaging actuator (782) during upward translation of spout (718) from the untriggered state to the triggered state. Thus, upward translation of spout (718) from the untriggered state to the triggered state may cause the upper surface of rail (776) to apply a threshold force sufficient to urge actuator (782) upwardly, to thereby transition switch (780) from an unactuated, deactivation state to an actuated, activation state in which switch (780) activates motor (150) to rotate scraper wheel (142). In one example, the resilient biasing of actuator (782) may enable switch (780) to automatically transition from the activation state to the deactivation state upon removal of the threshold force applied by the upper surface of rail (776) to actuator (782), such as during downward translation of spout (718) from the triggered state to the untriggered state, to deactivate motor (150) and cease rotating scraper wheel (142).

During operation, a user may insert a cup (C) into former (620) with the user's first hand (H1) and may subsequently lift spout (718) with the user's second hand (H2) to translate spout (718) in an upward direction from the untriggered state toward the triggered state, as indicated by twelfth arrow (A12) in FIG. 12. This action transitions switch (780) to the activation state to thereby activate motor (150) and dispense shaved ice (SI) into cup (C).

H. Exemplary Ice Shaving Machine Having Spout with Lever

Figure 13:
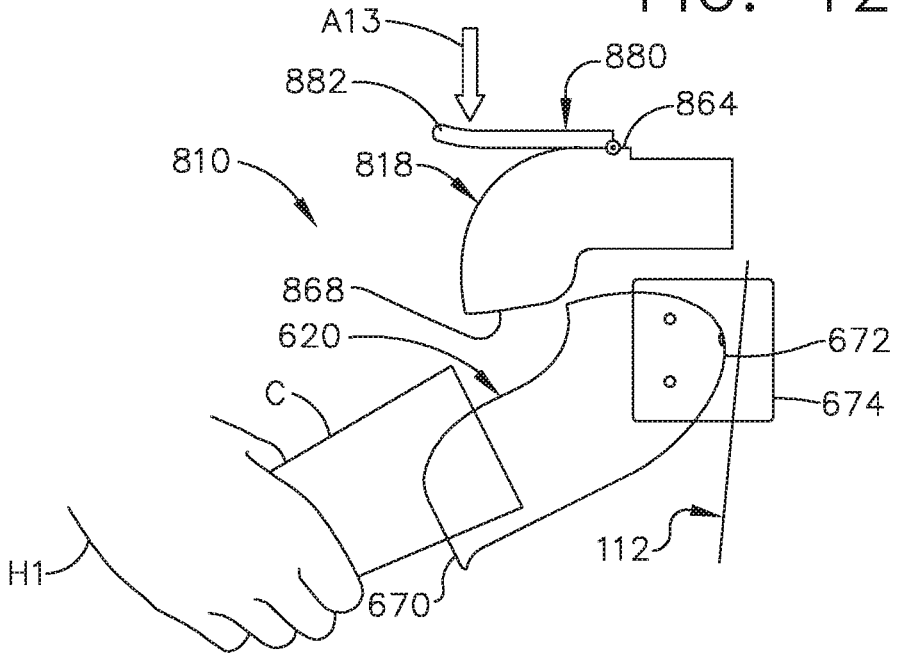
FIG. 13 depicts a schematic side elevational view of a portion of another exemplary ice shaving machine, showing a user inserting a cup into a cup support of a former of the ice shaving machine, and further showing the user pressing against a lever of a switch presented by a spout of the ice shaving machine to thereby transition the switch from a deactivation state toward an activation state.

FIG. 13 shows another exemplary ice shaving machine (810) configured to produce shaved ice in response to user-actuation of a movable structure defined by at least a portion of a spout of the ice shaving machine (810). Ice shaving machine (810) is similar to ice shaving machine (110) described above except as otherwise described below.

Ice shaving machine (810) of this example comprises housing (112), a spout (818) extending external to housing (112) and/or hopper (116) for dispensing shaved ice from ice shaving machine (810), and former (620).

Spout (818) of the present example includes a generally elbow-shaped conduit (864) including a passageway (not shown) which terminates at an outlet (868) positioned external to housing (112) and hopper (116). The passageway of conduit (864) may be in communication with annular cavity (138) for receiving shaved ice therefrom, and may be bent downwardly at an approximately 90° angle for redirecting such shaved ice from a radially outward flow path to a vertically downward flow path to thereby dispense the shaved ice downwardly via outlet (868). In the example shown, conduit (864) is fixedly coupled to housing (112) and a switch shown in the form of an electromechanical switch (880) is positioned on an upper surface of conduit (864) such that a resiliently-biased lever (882) of switch (880) is pivotable relative to housing (112) between the illustrated untriggered state and a triggered state. In one example, motor (150) is configured to drive scraper wheel (142) in response to pivoting of lever (882) relative to housing (112) from the untriggered state to the triggered state. In this regard, switch (880) is in operative communication with motor (150) for activating motor (150) in response to pivoting of lever (882) relative to housing (112) from the untriggered state to the triggered state.

During operation, a user may insert a cup (C) into former (620) with the user's first hand (H1) and may subsequently press lever (882) (e.g., with the user's second hand), as indicated by thirteenth arrow (A13) in FIG. 13, to pivot lever (882) in a counterclockwise direction (based on the frame of reference in FIG. 13) from the untriggered state toward the triggered state. This action transitions switch (880) to the activation state to thereby activate motor (150) and dispense shaved ice (SI) into cup (C).

I. Exemplary Ice Shaving Machine Having Pivotable Former and Spout Assembly

Figure 14:
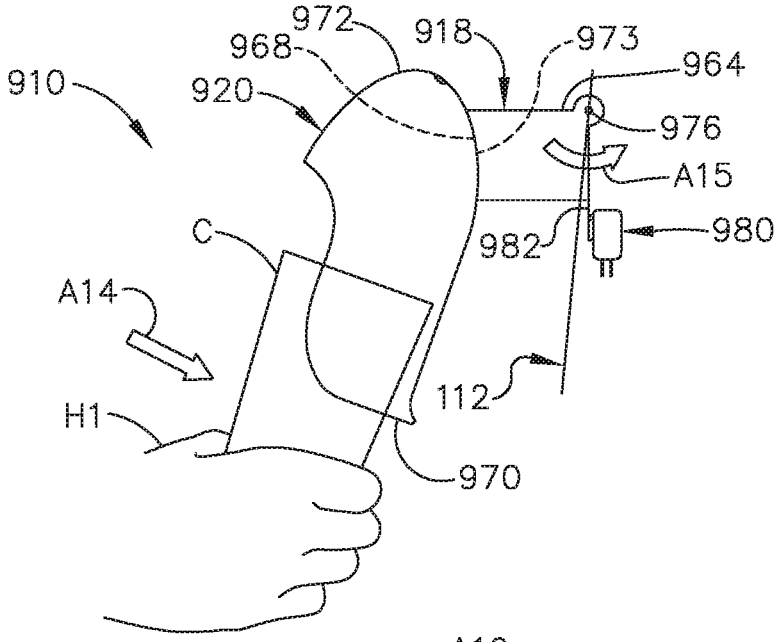
FIG. 14 depicts a schematic side elevational view of a portion of another exemplary ice shaving machine, showing a user inserting a cup into a cup support of a former and spout assembly of the ice shaving machine, and further showing the user pressing the cup against the cup support of the former and spout assembly to pivot the former and spout assembly from an unactuated state toward an actuated state to thereby transition a switch of the ice shaving machine from a deactivation state toward an activation state.
Figure 15:
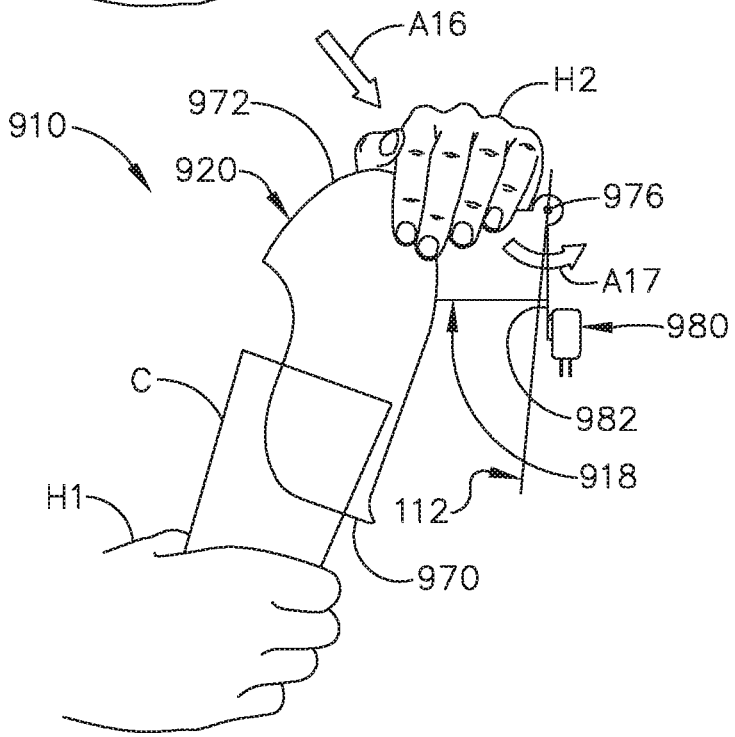
FIG. 15 depicts a schematic side elevational view of the portion of the ice shaving machine of FIG. 14, showing a user inserting a cup into the cup support of the former and spout assembly of the ice shaving machine, and further showing the user pressing against a spout portion of the former and spout assembly to pivot the former and spout assembly from the unactuated state toward the actuated state to thereby transition the switch of the ice shaving machine from the deactivation state toward the activation state.

FIGS. 14 and 15 show another exemplary ice shaving machine (910) configured to produce shaved ice in response to user-actuation of a movable structure defined by at least a portion of a former and spout assembly of the ice shaving machine (910). Ice shaving machine (910) is similar to ice shaving machine (110) described above except as otherwise described below.

Ice shaving machine (910) of this example comprises housing (112), a spout (918) extending external to housing (112) and/or hopper (116) for dispensing shaved ice from ice shaving machine (910), and a former (920) positioned at least partially below spout (918) for forming a dome-shaped top on the dispensed shaved ice.

Spout (918) and former (920) of the present example are directly, fixedly coupled to each other to define a combined unit (or "former and spout assembly"). More specifically, in the present example, spout (918) and former (920) are integrally formed to define a single unitary piece. In other examples, former (920) may be releasably coupled to spout (918) via any one or more suitable releasable coupling features (e.g., magnets) to define such a combined unit, for example as disclosed in U.S. Pat. No. 9,441,871, entitled "Shaping Device for a Shaved Ice or Snow Cone Product," issued Sep. 13, 2016, the disclosure of which is incorporated by reference herein.

Spout (918) includes a generally straight conduit (964) including a passageway (not shown) which terminates at an outlet (968) positioned external to housing (112) and hopper (116). The passageway of conduit (964) may be in communication with annular cavity (138) for receiving shaved ice therefrom. Former (920) includes a cup guide or cup support (970) and a dome (972) having an inlet (973) which directly interfaces with outlet (968) such that the passageway of conduit (964) is in communication with an interior of former (920) for directing shaved ice into former (920) via outlet (968) and inlet (973). In the example shown, spout (918) and former (920) are collectively pivotably coupled to housing (112) such that spout (918) and former (920) are pivotable together relative to housing (112) between the illustrated untriggered state and a triggered state. More particularly, a pivot pin (976) pivotably couples an end of spout (918) opposite from outlet (968) to housing (112). Spout (918) and former (920) may be resiliently biased together toward the untriggered state, such as via a torsion spring or any other suitable biasing member (not shown). In one example, motor (150) is configured to drive scraper wheel (142) in response to pivoting of spout (918) and former (920) together relative to housing (112) from the untriggered state to the triggered state.

In this regard, a switch shown in the form of an electromechanical switch (980) is positioned on an outer surface of housing (112) and is in operative communication with motor (150) for activating motor (150) in response to pivoting of spout (918) and former (920) together relative to housing (112) from the untriggered state to the triggered state. More particularly, spout (918) is configured to actuate switch (980) when spout (918) and former (920) are pivoted together from the untriggered state to the triggered state. To this end, switch (980) of the present example includes a resiliently-biased actuator (982), and conduit (964) of spout (918) includes a rear surface for selectively engaging actuator (982) during pivoting of spout (918) and former (920) together from the untriggered state to the triggered state. Thus, pivoting of spout (918) and former (920) together from the untriggered state to the triggered state may cause the rear surface of conduit (964) to apply a threshold force sufficient to urge actuator (982) rearwardly, to thereby transition switch (980) from an unactuated, deactivation state to an actuated, activation state in which switch (980) activates motor (150) to rotate scraper wheel (142). In one example, the resilient biasing of actuator (982) may enable switch (980) to automatically transition from the activation state to the deactivation state upon removal of the threshold force applied by the rear surface of conduit (964) to actuator (982), such as during pivoting of spout (918) and former (920) together from the triggered state to the untriggered state, to deactivate motor (150) and cease rotating scraper wheel (142).

During operation, a user may insert a cup (C) into cup support (970) of former (920) with the user's first hand (H1) and may subsequently press the cup (C) against an inner surface of cup support (970), as indicated by fourteenth arrow (A14) in FIG. 14, to pivot spout (918) and former (920) together in a counterclockwise direction (based on the frame of reference in FIG. 14) from the untriggered state toward the triggered state, as indicated by fifteenth arrow (A15) in FIG. 14. In addition or alternatively, a user may insert a cup (C) into cup support (970) of former (920) with the user's first hand (H1) and may subsequently press spout (918) with the user's second hand (H2), as indicated by sixteenth arrow (A16) in FIG. 15, to pivot spout (918) and former (920) together in a counterclockwise direction (based on the frame of reference in FIG. 15) from the untriggered state toward the triggered state, as indicated by seventeenth arrow (A17) in FIG. 15. In either case, this action transitions switch (980) to the activation state to thereby activate motor (150) and dispense shaved ice (SI) into cup (C).

Figure 16:
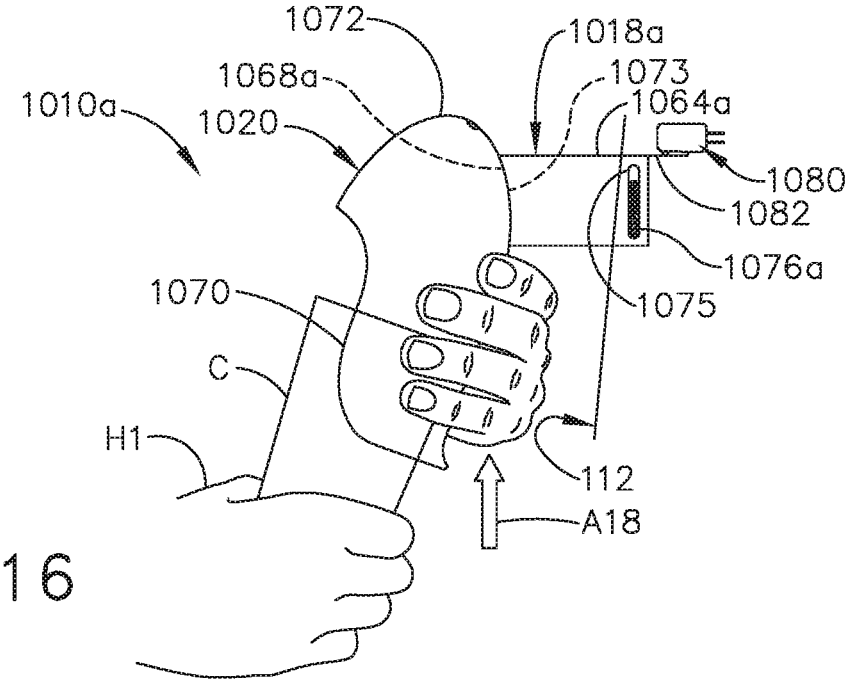
FIG. 16 depicts a schematic side elevational view of a portion of another exemplary ice shaving machine, showing a user inserting a cup into a cup support of a former and spout assembly of the ice shaving machine, and further showing the user lifting a former portion of the former and spout assembly to translate the former and spout assembly in an upward direction from an unactuated state toward an actuated state to thereby transition a switch of the ice shaving machine from a deactivation state toward an activation state.
Figure 17:
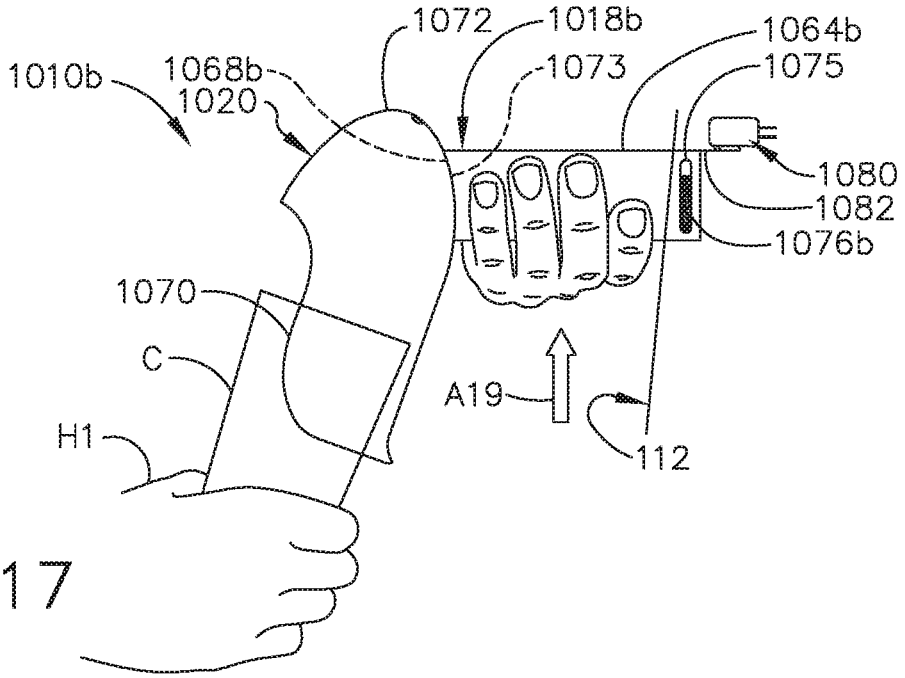
FIG. 17 depicts a schematic side elevational view of a portion of another exemplary ice shaving machine, showing a user inserting a cup into a cup support of a former and spout assembly of the ice shaving machine, and further showing the user lifting a spout portion of the former and spout assembly to translate the former and spout assembly in an upward direction from an unactuated state toward an actuated state to thereby transition a switch of the ice shaving machine from a deactivation state toward an activation state.

J. Exemplary Ice Shaving Machines Having Upwardly Translatable Former and Spout Assembly FIGS. 16 and 17 show other exemplary ice shaving machines (1010*a*, 1010*b*) configured to produce shaved ice in response to user-actuation of a movable structure defined by at least a portion of a former and spout assembly of the ice shaving machine (1010*a*, 1010*b*). Ice shaving machines (1010*a*, 1010*b*) are similar to ice shaving machine (910) described above except as otherwise described below.

Ice shaving machines (1010*a*, 1010*b*) of these examples each comprise housing (112), a spout (1018*a*, 1018*b*) extending external to housing (112) and/or hopper (116) for dispensing shaved ice from ice shaving machine (1010*a*, 1010*b*), and a former (1020) positioned at least partially below spout (1018*a*, 1018*b*) for forming a dome-shaped top on the dispensed shaved ice. Spout (1018*a*, 1018*b*) and former (1020) of the present examples are directly, fixedly coupled to each other and, more particularly, are integrally formed together as a unitary piece, to define a combined unit (or "former and spout assembly"). In other examples, former (1020) may be releasably coupled with spout (1018*a*, 1018*b*) so as to define a former and spout assembly.

Spout (1018*a*, 1018*b*) includes a generally straight conduit (1064*a*, 1064*b*) including a passageway (not shown) which terminates at an outlet (1068*a*, 1068*b*) positioned external to housing (112) and hopper (116). By way of comparison, conduit (1064*b*) of spout (1018*b*) illustrated in FIG. 17 is relatively longer than conduit (1064*a*) of spout (1018*a*) illustrated in FIG. 16. The passageway of conduit (1064*a*, 1064*b*) may be in communication with annular cavity (138) for receiving shaved ice therefrom. Former (1020) includes a cup guide or cup support (1070) and a dome (1072) having an inlet (1073) which directly interfaces with outlet (1068*a*, 1068*b*) such that the passageway of conduit (1064*a*, 1064*b*) is in communication with an interior of former (1020) for directing shaved ice into former (1020) via outlet (1068*a*, 1068*b*) and inlet (1073). In the examples shown, spout (1018*a*, 1018*b*) and former (1020) are collectively translatably coupled to housing (112) such that spout (1018*a*, 1018*b*) and former (1020) are translatable together relative to housing (112) between the illustrated untriggered state and a triggered state. More particularly, housing (112) includes at least one slot (1075) which slidably retains at least one respective rail (1076*a*, 1076*b*) extending laterally outwardly from conduit (1064*a*, 1064*b*) of spout (1018*a*, 1018*b*). Spout (1018*a*, 1018*b*) and former (1020) may be resiliently biased together toward the untriggered state, such as via a tension or compression spring or any other suitable biasing member (not shown). In one example, motor (150) is configured to drive scraper wheel (142) in response to upward translation of spout (1018*a*, 1018*b*) and former (1020) together relative to housing (112) from the untriggered state to the triggered state.

In this regard, a switch shown in the form of an electromechanical switch (1080) is positioned on an outer surface of housing (112) and is in operative communication with motor (150) for activating motor (150) in response to upward translation of spout (1018*a*, 1018*b*) and former (1020) together relative to housing (112) from the untriggered state to the triggered state. More particularly, spout (1018*a*, 1018*b*) is configured to actuate switch (1080) when spout (1018*a*, 1018*b*) and former (1020) are translated upwardly together from the untriggered state to the triggered state. To this end, switch (1080) of the present example includes a resiliently-biased actuator (1082), and conduit (1064*a*, 1064*b*) of spout (1018*a*, 1018*b*) includes an upper surface for selectively engaging actuator (1082) during upward translation of spout (1018*a*, 1018*b*) and former (1020) together from the untriggered state to the triggered state. Thus, upward translation of spout (1018*a*, 1018*b*) and former (1020) together from the untriggered state to the triggered state may cause the upper surface of conduit (1064*a*, 1064*b*) to apply a threshold force sufficient to urge actuator (1082) upwardly, to thereby transition switch (1080) from an unactuated, deactivation state to an actuated, activation state in which switch (1080) activates motor (150) to rotate scraper wheel (142). In one example, the resilient biasing of actuator (1082) may enable switch (1080) to automatically transition from the activation state to the deactivation state upon removal of the threshold force applied by the upper surface of conduit (1064*a*, 1064*b*) to actuator (1082), such as during downward translation of spout (1018*a*, 1018*b*) and former (1020) together from the triggered state to the untriggered state, to deactivate motor (150) and cease rotating scraper wheel (142).

During operation, a user may insert a cup (C) into cup support (1070) of former (1020) with the user's first hand (H1) and may subsequently lift former (1020) with the user's second hand (H2) to translate spout (1018*a*, 1018*b*) and former (1020) together in an upward direction from the untriggered state toward the triggered state, as indicated by eighteenth arrow (A18) in FIG. 16. In addition or alternatively, a user may insert a cup (C) into cup support (1070) of former (1020) with the user's first hand (H1) and may subsequently lift spout (1018*a*, 1018*b*) with the user's second hand (H2) to translate spout (1018*a*, 1018*b*) and former (1020) together in an upward direction from the untriggered state toward the triggered state, as indicated by nineteenth arrow (A19) in FIG. 17. The former method may be particularly suitable for the relatively shorter conduit (1064*a*) such that former (1020) may provide a more desirable gripping area for the user's second hand (H2) than spout (1018*a*). By comparison, the latter method may be particularly suitable for the relatively longer conduit (1064*b*), such that spout (1018*b*) may provide ample gripping area for the user's second hand (H2). In either case, this action transitions switch (1080) to the activation state to thereby activate motor (150) and dispense shaved ice (SI) into cup (C).

Figure 18A:
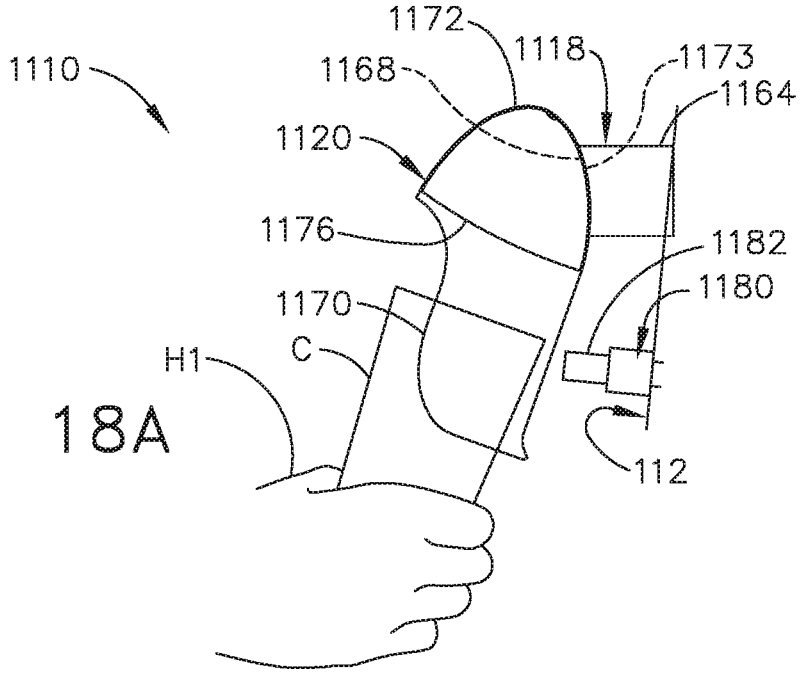
FIG. 18A depicts a schematic side elevational view of a portion of another exemplary ice shaving machine, showing a user inserting a cup into a flexible cup support of a former and spout assembly of the ice shaving machine, and further showing the flexible cup support in an unactuated state and a switch of the ice shaving machine in a deactivation state.
Figure 18B:
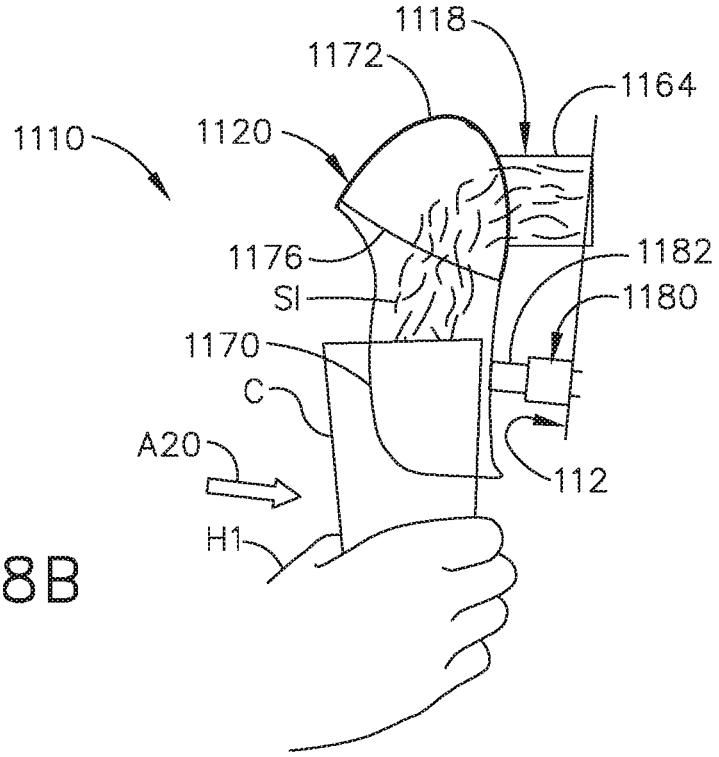
FIG. 18B depicts a schematic side elevational view of the portion of the ice shaving machine of FIG. 18A, showing the user pressing the cup against the flexible cup support of the former and spout assembly to flex the flexible cup support from the unactuated state toward an actuated state to thereby transition the switch of the ice shaving machine from the deactivation state toward an activation state for dispensing shaved ice into the cup via the former and spout assembly.

K. Exemplary Ice Shaving Machine Having Former and Spout Assembly with Flexible Portion FIGS. 18A-18B show another exemplary ice shaving machine (1110) configured to produce shaved ice in response to user-actuation of a movable structure defined by at least a portion of a former and spout assembly of the ice shaving machine (1110). Ice shaving machine (1110) is similar to ice shaving machine (910) described above except as otherwise described below.

Ice shaving machine (1110) of this example comprises housing (112), a spout (1118) extending external to housing (112) and/or hopper (116) for dispensing shaved ice from ice shaving machine (1110), and a former (1120) positioned at least partially below spout (1118) for forming a dome-shaped top on the dispensed shaved ice. Spout (1118) and former (1120) of the present example are directly, fixedly coupled to each other and, more particularly, are integrally formed together as a unitary piece, to define a combined unit (or "former and spout assembly"). In other examples, former (1120) may be releasably coupled with spout (1118) so as to define a former and spout assembly.

Spout (1118) includes a generally straight conduit (1164) including a passageway (not shown) which terminates at an outlet (1168) positioned external to housing (112) and hopper (116). The passageway of conduit (1164) may be in communication with annular cavity (138) for receiving shaved ice therefrom. Former (1120) includes a cup guide or cup support (1170) and a dome (1172) having an inlet (1173) which directly interfaces with outlet (1168) such that the passageway of conduit (1164) is in communication with an interior of former (1120) for directing shaved ice into former (1120) via outlet (1168) and inlet (1173). In the example shown, cup support (1170) is flexibly coupled to dome (1172), and dome (1172) is fixedly coupled to housing (112) via conduit (1164) such that cup support (1170) is flexible relative to housing (112) between an untriggered state (FIG. 18A) and a triggered state (FIG. 18B). More particularly, a living hinge (1176) flexibly couples cup support (1170) to dome (1172). Cup support (1170) may be resiliently biased toward the untriggered state, such as via a material property of living hinge (1176). In one example, motor (150) is configured to drive scraper wheel (142) in response to flexing of cup support (1170) relative to housing (112) from the untriggered state to the triggered state.

In this regard, a switch shown in the form of an electromechanical switch (1180) is positioned on an outer surface of housing (112) and is in operative communication with motor (150) for activating motor (150) in response to flexing of cup support (1170) relative to housing (112) from the untriggered state to the triggered state. More particularly, cup support (1170) is configured to actuate switch (1180) when cup support (1170) is flexed from the untriggered state to the triggered state. To this end, switch (1180) of the present example includes a resiliently-biased actuator in the form of a button (1182), and cup support (1170) includes an outer surface for selectively engaging button (1182) during flexing of cup support (1170) from the untriggered state to the triggered state. Thus, flexing of cup support (1170) from the untriggered state to the triggered state may cause the outer surface of cup support (1170) to apply a threshold force sufficient to depress button (1182), to thereby transition switch (1180) from an unactuated, deactivation state to an actuated, activation state in which switch (1180) activates motor (150) to rotate scraper wheel (142). In one example, the resilient biasing of button (1182) may enable switch (1180) to automatically transition from the activation state to the deactivation state upon removal of the threshold force applied by the outer surface of cup support (1170) to button (1182), such as during flexing of cup support (1170) from the triggered state to the untriggered state, to deactivate motor (150) and cease rotating scraper wheel (142).

In some versions, flexible cup support (1170) itself may be used as a shaping device in addition to or in place of dome (1172) of former (1120) for shaping dispensed shaved ice. In some such versions, spout (1118), former (1120), and its flexible cup support (1170) may be further configured in accordance with at least some of the teachings of U.S. Pat. No. 6,527,212, entitled "Ice Shaver," issued Mar. 4, 2003; and/or U.S. Pat. No. 10,443,916, entitled "Portable Frozen Confection Machine," issued Oct. 15, 2019, the disclosures of each of these patents being incorporated by reference herein.

During operation, a user may insert a cup (C) into cup support (1170) of former (1120) with the user's first hand (H1) and may subsequently press the cup (C) against an inner surface of cup support (1170), as indicated by twentieth arrow (A20) in FIG. 18B, to flex cup support (1170) from the untriggered state toward the triggered state for dispensing shaved ice (SI) into the cup (C) via spout (118), as shown in FIG. 18B. This action transitions switch (1180)

to the activation state to thereby activate motor (150) and dispense shaved ice (SI) into cup (C).

As described above with reference to the exemplary ice shaving systems shown in FIGS. 1-18B, an ice shaving system having a body may be provided with a movable structure that is movably coupled to the body, whereby actuation of the movable structure relative to the body activates a motor of the system to generate shaved ice. While the exemplary systems are shown and described with movable structures that are defined by one or more particular components of the respective system (e.g., a former and/or a spout), it will be appreciated that such movable structures may be defined by one or more various other suitable components of the systems in other versions. For instance, an ice shaving system may include a cup support structure having a platform, a recess, and/or various other suitable features readily apparent to those of ordinary skill in the art, whereby actuation of or simply contact with a portion of the cup support structure by the cup may activate the motor of the ice shaving system. Moreover, and as described above with exemplary reference to FIGS. 11-13, it will be appreciated that some such ice shaving systems may include a shaping device (or "former") that is provided independently from the body, or the shaping device may be omitted from the system entirely, without affecting functionality of the movable structure.

II. Miscellaneous

It should be understood that any one or more of the teachings, expressions, embodiments, examples, etc. described herein may be combined with any one or more of the other teachings, expressions, embodiments, examples, etc. that are described herein. The above-described teachings, expressions, embodiments, examples, etc. should therefore not be viewed in isolation relative to each other. Various suitable ways in which the teachings herein may be combined will be readily apparent to those skilled in the art in view of the teachings herein. Such modifications and variations are intended to be included within the scope of the claims.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

We claim:

1. An ice shaving system, comprising:

(a) a body;

(b) a driven member positioned within the body, wherein the driven member is drivable to produce shaved ice;

(c) a motor configured to selectively drive the driven member;

(d) a spout having an outlet, wherein the spout is configured to dispense the shaved ice via the outlet; and (e) a shaping device configured to form a portion of the dispensed shaved ice with a predetermined shape, wherein at least a portion of at least one of the spout or the shaping device defines a movable structure that is movable relative to the body, wherein the motor is selectively activatable to drive the driven member in response to actuation of the movable structure relative to the body, wherein the shaping device is coupled to the body and at least a portion of the shaping device defines the movable structure.

2. The ice shaving system of claim 1, wherein the shaping device defines the movable structure and is pivotable relative to the body, wherein the motor is configured to drive the driven member in response to pivoting of the shaping device relative to the body.

3. The ice shaving system of claim 1, wherein the driven member includes at least one of a blade or a scraper.

4. An ice shaving system, comprising:

(a) a body;

(b) a driven member positioned within the body, wherein the driven member is drivable to produce shaved ice;

(c) a motor configured to selectively drive the driven member;

(d) a spout having an outlet, wherein the spout is configured to dispense the shaved ice via the outlet;

(e) a shaping device configured to form a portion of the dispensed shaved ice with a predetermined shape, wherein at least a portion of at least one of the spout or the shaping device defines a movable structure that is movable relative to the body; and (f) a switch in operative communication with the motor, wherein the switch is configured to activate the motor in response to actuation of the movable structure relative to the body, wherein the shaping device defines the movable structure and is pivotable relative to the body, wherein the switch is configured to activate the motor in response to pivoting of the shaping device relative to the body.

5. An ice shaving system, comprising:

(a) a body;

(b) a driven member positioned within the body, wherein the driven member is drivable to produce shaved ice;

(c) a motor configured to selectively drive the driven member;

(d) a spout having an outlet, wherein the spout is configured to dispense the shaved ice via the outlet;

(e) a shaping device configured to form a portion of the dispensed shaved ice with a predetermined shape, wherein at least a portion of at least one of the spout or the shaping device defines a movable structure that is movable relative to the body; and (f) a switch in operative communication with the motor, wherein the switch is configured to activate the motor in response to actuation of the movable structure relative to the body, wherein the switch is positioned on an outer surface of the body, wherein the shaping device defines the movable structure and is configured to actuate the switch when the shaping device is moved relative to the body.

6. A method of producing shaved ice using an ice shaving system including a body, a driven member, and a motor, the method comprising:

(a) actuating a movable structure relative to the body, wherein the movable structure is defined by at least a portion of at least one of a spout or a shaping device of the ice shaving system; and (b) driving the driven member via the motor to produce shaved ice in response to the act of actuating the movable structure relative to the body, wherein the shaping device is movably coupled to the body, wherein the act of actuating the movable structure relative to the body includes actuating the shaping device relative to the body.

* * * * *